US006634640B1

(12) United States Patent
Yoshizawa et al.

(10) Patent No.: US 6,634,640 B1
(45) Date of Patent: Oct. 21, 2003

(54) ATTACHABLE/DETACHABLE SHEET SORTING DEVICE AND SHEET DISCHARGING SYSTEM USING THE SHEET SORTING DEVICE

(75) Inventors: Hiroshi Yoshizawa, Yokohama (JP); Masaru Watanabe, Mitaka (JP); Rikio Kasahara, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/572,257

(22) Filed: May 17, 2000

(30) Foreign Application Priority Data

Jun. 8, 1999 (JP) ..... 11-160413
Mar. 28, 2000 (JP) ..... 2000-088691

(51) Int. Cl.[7] ..... B65H 31/04
(52) U.S. Cl. ..... 271/213; 271/217
(58) Field of Search ..... 271/207, 213, 271/214, 217; 209/695, 900, 921

(56) References Cited

U.S. PATENT DOCUMENTS 5,350,169 A * 9/1994 Hiroi et al. ..... 271/213
5,618,035 A * 4/1997 Coombs et al. ..... 271/217 X
5,737,987 A * 4/1998 Olson et al. ..... 271/213 X

FOREIGN PATENT DOCUMENTS

JP 1-187173 * 7/1989 ..... 271/213
JP 08091677 A 4/1996
JP 08143211 A 6/1996
JP 09086785 A 3/1997
JP 10152241 A 6/1998
JP 11130334 A 5/1999

OTHER PUBLICATIONS

U.S. patent application Ser. No. 09/572,257, filed May 17, 2000, Pending.
U.S. patent application Ser. No. 09/925,657, filed Aug. 10, 2001, Pending.
U.S. patent application Ser. No. 09/956,900, filed Sep. 21, 2001, Pending.
U.S. patent application Ser. No. 10/247,644, filed Sep. 20, 2002, Pending.

* cited by examiner

*Primary Examiner*—Tuan N. Nguyen
(74) *Attorney, Agent, or Firm*—Oblon, Spivak, McClelland, Maier & Neustadt, P.C.

(57) ABSTRACT

A sheet sorting device for a sheet discharging apparatus which has a sheet discharging tray which receives discharged sheets when the sheet sorting device is not attached to the sheet discharging tray. The sheet sorting device includes a movable tray which is configured to receive sheets discharged from the sheet discharging apparatus and configured to reciprocate in a reciprocating direction substantially perpendicular to a sheet conveying direction of the sheet discharging apparatus by a predetermined stroke necessary for sorting sheets. The sheets are sorted by reciprocating the movable tray in the reciprocating direction. The sheet sorting device is configured to detachably attached to the sheet discharging tray.

43 Claims, 24 Drawing Sheets

ATTACHABLE/DETACHABLE SHEET SORTING DEVICE AND SHEET DISCHARGING SYSTEM USING THE SHEET SORTING DEVICE

CROSS-REFERENCE TO RELATED APPLICATIONS

The present application claims priority under 35 U.S.C. §119 to Japanese Patent Applications No. 11-160413, filed Jun. 8, 1999, and No. 2000-088691, filed Mar. 28, 2000. The contents of these applications are incorporated herein by reference in their entirety.

BACKGROUND OF THE INVENTION

1. Field of the Invention

The present invention relates to a sheet sorting device which is attachable/detachable to/from a sheet discharging apparatus.

2. Discussion of the Background

Japanese Laid-open Patent Publication No. 8-91677 describes a sheet sorting device which sorts sheets discharged from an image forming apparatus such as a copying machine and a printer by shifting in a direction perpendicular to a sheet conveying direction by a predetermined stroke. The contents of this reference are incorporated herein by reference in their entirety.

The above-described sheet sorting device includes main elements such as an overall frame supporting a pair of sheet discharging rollers and a driving mechanism. The sheet sorting device is integrally provided with the image forming apparatus as a part thereof. Specifically, a sheet post-processing apparatus is attached downstream of a main body of the image forming apparatus in the sheet conveying direction, and includes the sheet sorting device therein. In the sheet post-processing apparatus, the sheet sorting device is provided at an intermediate position between a pair of sheet receiving rollers which is located at the most upstream side with respect to the sheet conveying direction to receive the sheets conveyed from the main body and a sheet discharging tray which is located at the most downstream side with respect to the sheet conveying direction.

In the above-described sheet post-processing apparatus, in a sort mode, the sheets are discharged to the sheet discharging tray via the sheet sorting device after passing through the sheet conveying path extending across the sheet post-processing apparatus. In a non-sort mode, the sheets are also discharged to the sheet discharging tray via the sheet sorting device without being sorted. In both sort and non-sort modes, because the sheets are conveyed across the sheet post-processing apparatus via the sheet sorting device, it takes time to discharge the sheets to the sheet discharging tray after receiving the sheets from the main body of the image forming apparatus.

In this type of image forming apparatus wherein a sheet post-processing apparatus including a sheet sorting device is attached downstream of the main body of the image forming apparatus in the sheet conveying direction, if a user who originally operates only non-sorting jobs and uses a sheet discharging tray without attaching the sheet post-processing apparatus, and if the user needs to operate sheet sorting jobs later, the user needs to attach the sheet post-processing apparatus including the sheet sorting device next to the main body of the image forming apparatus. As a result, the sheet post-processing apparatus occupies space.

Another background sheet post-processing apparatus for use in an image forming apparatus includes a sheet discharging tray having sheet sorting and stapling functions. Because the sheet sorting operation is performed in the sheet post-processing apparatus, a user who operates not stapling jobs but sheet sorting jobs needs to attach the sheet post-processing apparatus including devices both for sheet sorting and stapling to the image forming apparatus. Consequently, the user needs to attach the sheet post-processing apparatus of increased size.

SUMMARY OF THE INVENTION

The present invention has been made in view of the above-discussed and other problems, and an object of the present invention is to address these problems.

The preferred embodiment of the present invention provides a novel sheet sorting device and sheet discharging apparatus that can reduce a sheet conveying distance and time for discharging sheets to a tray.

The preferred embodiment of the present invention provides a novel sheet sorting device and sheet discharging apparatus wherein the sheet sorting device can be easily attached to the sheet discharging apparatus in a compact and space saving configuration.

These objects and others are achieved according to the present invention by providing a novel sheet sorting device for a sheet discharging apparatus which has a sheet discharging tray which receives discharged sheets when the sheet sorting device is not attached to the sheet discharging tray. The sheet sorting device includes a movable tray which is configured to receive sheets discharged from the sheet discharging apparatus and configured to reciprocate in a reciprocating direction substantially perpendicular to a sheet conveying direction of the sheet discharging apparatus by a predetermined stroke necessary for sorting sheets. The sheets are sorted by reciprocating the movable tray in the reciprocating direction. The sheet sorting device is configured to detachably attached to the sheet discharging tray.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
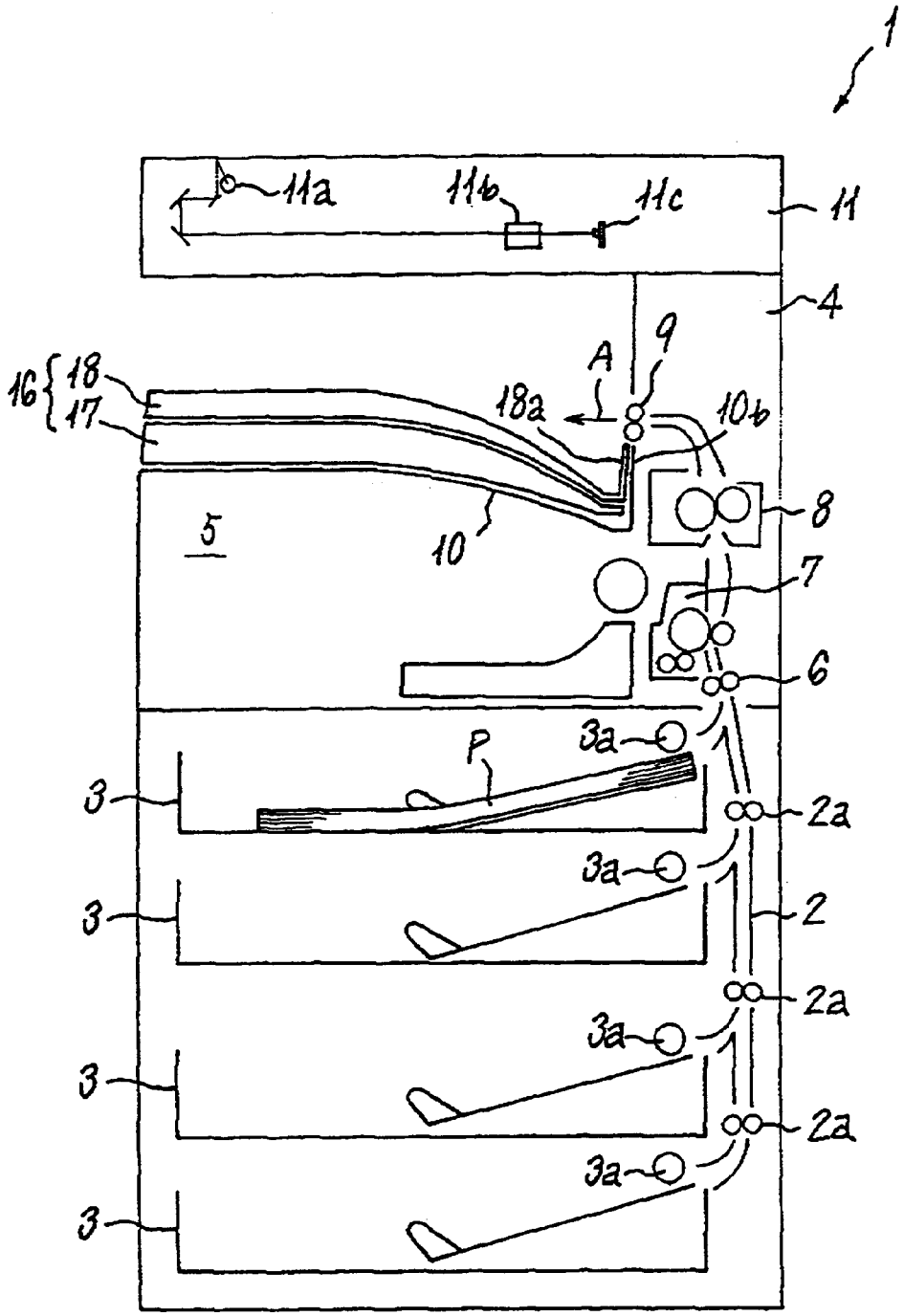
FIG. 1 is a schematic view illustrating an overall construction of a sheet discharging apparatus to which a sheet sorting device is attached according to an embodiment of the present invention.

Referring now to the drawings, wherein like reference numerals designate identical or corresponding parts throughout the several views, embodiments of the present invention are now described.

Generally, a sheet discharging apparatus has a single function of discharging sheets. In this embodiment, a sheet discharging apparatus also includes an image forming device, and the schematic configuration of the sheet discharging apparatus is described referring to FIG. 2. A sheet discharging apparatus 1 as a whole is of substantially box shape in which three units of box shape are stacked; a lower unit 1D, a middle unit 1M, and an upper unit 1U.

In the lower unit 1D, four sheet feeding cassettes 3 are provided in a vertical direction. Respective sheet feeding cassettes 3 can be drawn out in the direction perpendicular to the paper surface of FIG. 2, and accommodate sheets of different sizes. In this exemplary embodiment, only the uppermost sheet feeding cassette 3 accommodates sheets P. Sheet feeding rollers 3*a* are provided with the sheet feeding cassettes 3, respectively, to feed the sheet P sheet by sheet to the right-hand side of FIG. 2 by rotations. At the right side of each sheet feeding cassette 3, a vertical sheet conveying path 2 extending upward is provided. Each pair of sheet conveying rollers 2*a* is provided in the vertical sheet conveying path 2 and is spaced apart from each other.

With the above-described construction, the sheet P fed by the sheet feeding rollers 3*a* is conveyed upward to the middle unit 1M through the vertical sheet conveying path 2. In the middle unit 1M, an image forming device 4 and a main body 5 are provided. The image forming device 4 is of a box-shaped structure which is positioned substantially above the vertical sheet conveying path 2. The main body 5 is also of box-shaped structure which is integrally provided on the lower left side surface of the image forming device 4, and is positioned above the sheet feeding cassettes 3.

Provided in the image forming device 4 are a pair of registration rollers 6, an image forming unit 7, a fixing unit 8, and a pair of sheet discharging rollers 9 in the order in the extending direction from the sheet conveying path 2. It is configured that the sheet P is discharged from the sheet discharging rollers 9 to the left-hand side of FIG. 2, i.e., in a sheet conveying direction indicated by an arrow A in FIG. 2 (hereinafter referred to as a sheet conveying direction A) toward the upper surface of the main body 5.

Provided in the main body 5 are a power supply for driving the sheet discharging apparatus 1, a control device which controls the sheet discharging apparatus 1, and a laser writing device.

The image forming unit 7 includes a photoconductive drum, and a charging unit, a developing unit, a transfer unit, and a cleaning unit for the photoconductive drum which are all provided around the photoconductive drum. Atoner image is formed on the photoconductive drum by a known electrophotographic process, and then are transferred to the sheet P by the transfer unit. Subsequently, the sheet P is conveyed to the fixing unit 8. The registration rollers 6 are controlled to feed the sheet P conveyed through the vertical sheet conveying path 2 such that a leading edge of the sheet P reaches a transfer station in the image forming unit 7 at a timing in alignment with a leading edge of the toner image formed on the photoconductive drum.

Figure 2:
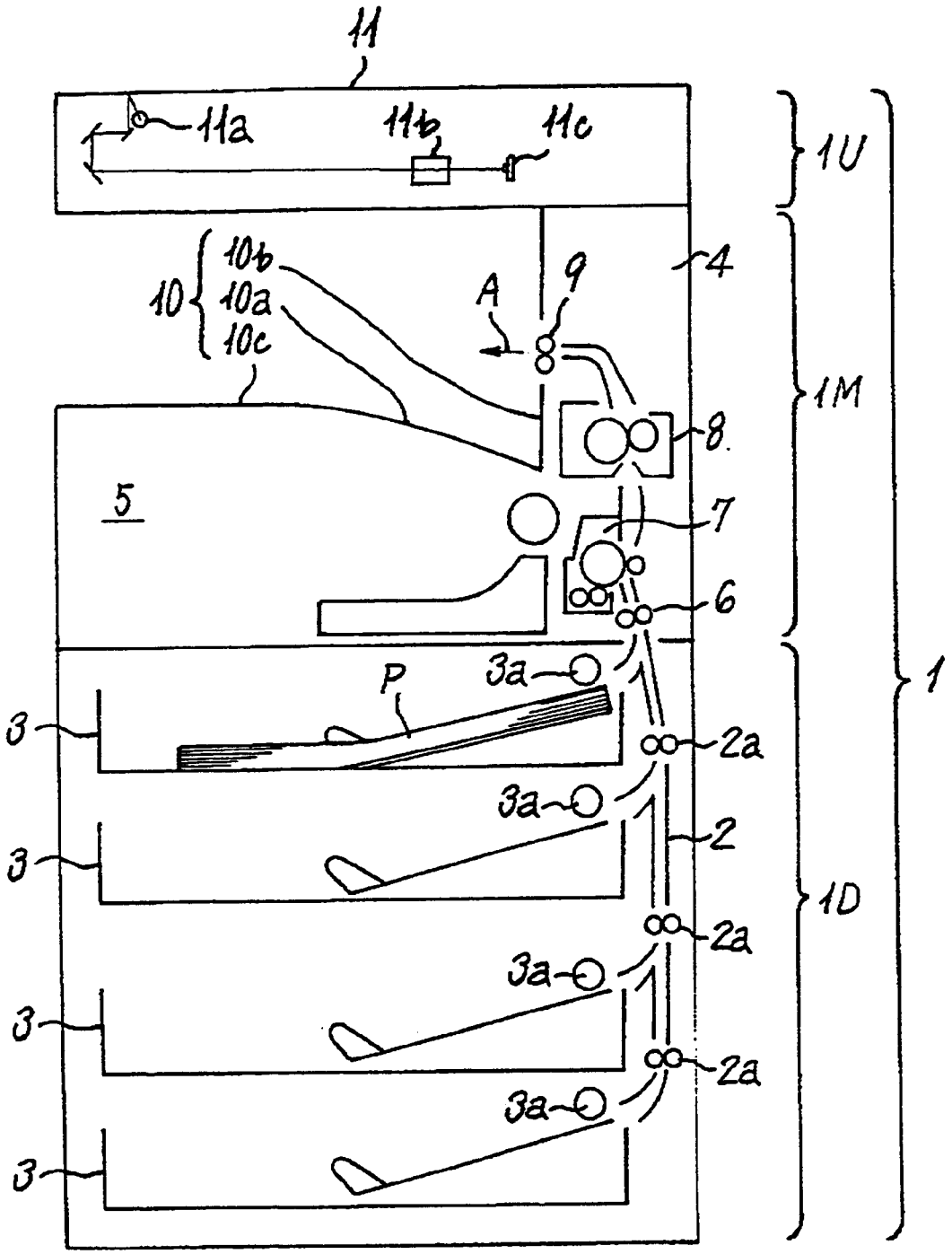
FIG. 2 is a schematic view illustrating the sheet discharging apparatus to which the sheet sorting device is not attached according to an embodiment of the present invention.
Figure 3:
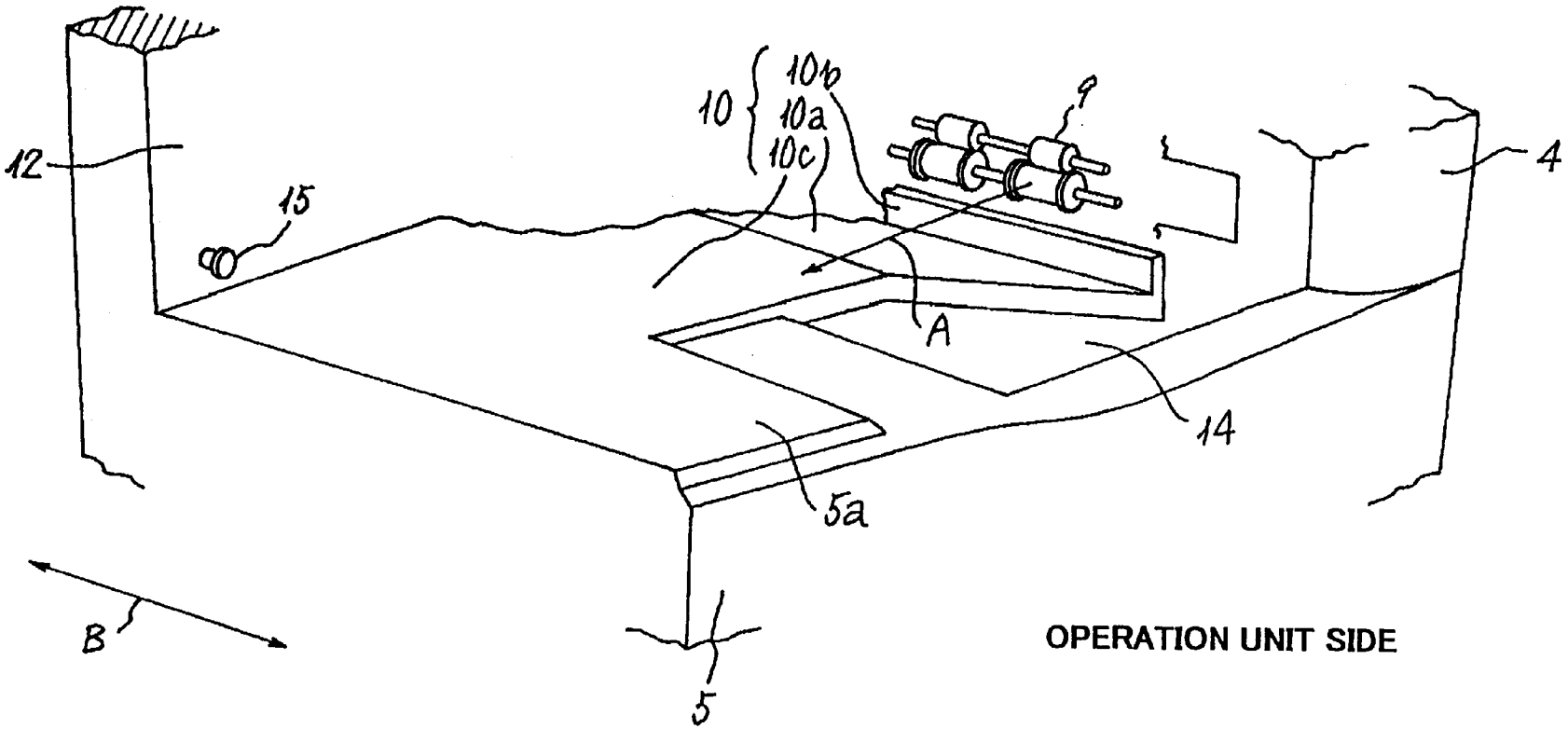
FIG. 3 is a perspective view illustrating a sheet discharging tray and surrounding elements according to an embodiment of the present invention.

Referring to FIGS. 2 and 3, the sheet P, on which the toner image is fixed after passing through the fixing unit 8, is discharged from the sheet discharging rollers 9 in the sheet conveying direction A and falls on a sheet discharging tray 10. The sheet discharging tray 10 is integrally provided on the upper portion of the main body 5. Specifically, the sheet discharging tray 10 includes a slope 10*a* which slopes upward in the sheet conveying direction A, a wall 10*b* which vertically stands at the upstream end of the slope 10*a* in the sheet conveying direction A and substantially below the sheet discharging rollers 9, and a horizontal surface 10*c* which connects to the downstream end of the slope 10*a* in the sheet conveying direction A.

Figure 4:
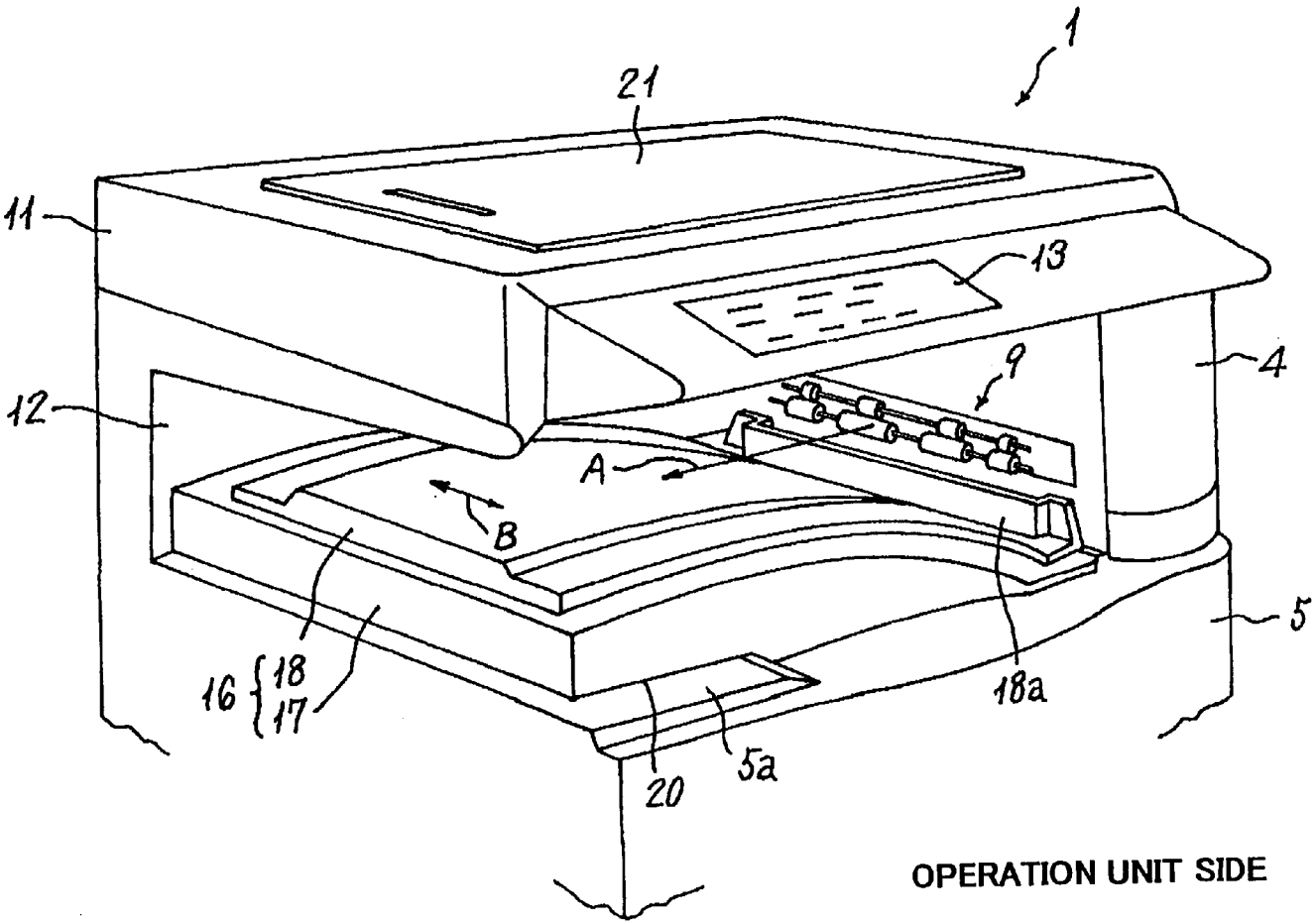
FIG. 4 is a perspective view illustrating the sheet sorting device attached on the sheet discharging tray and its surroundings according to an embodiment of the present invention.
Figure 5:
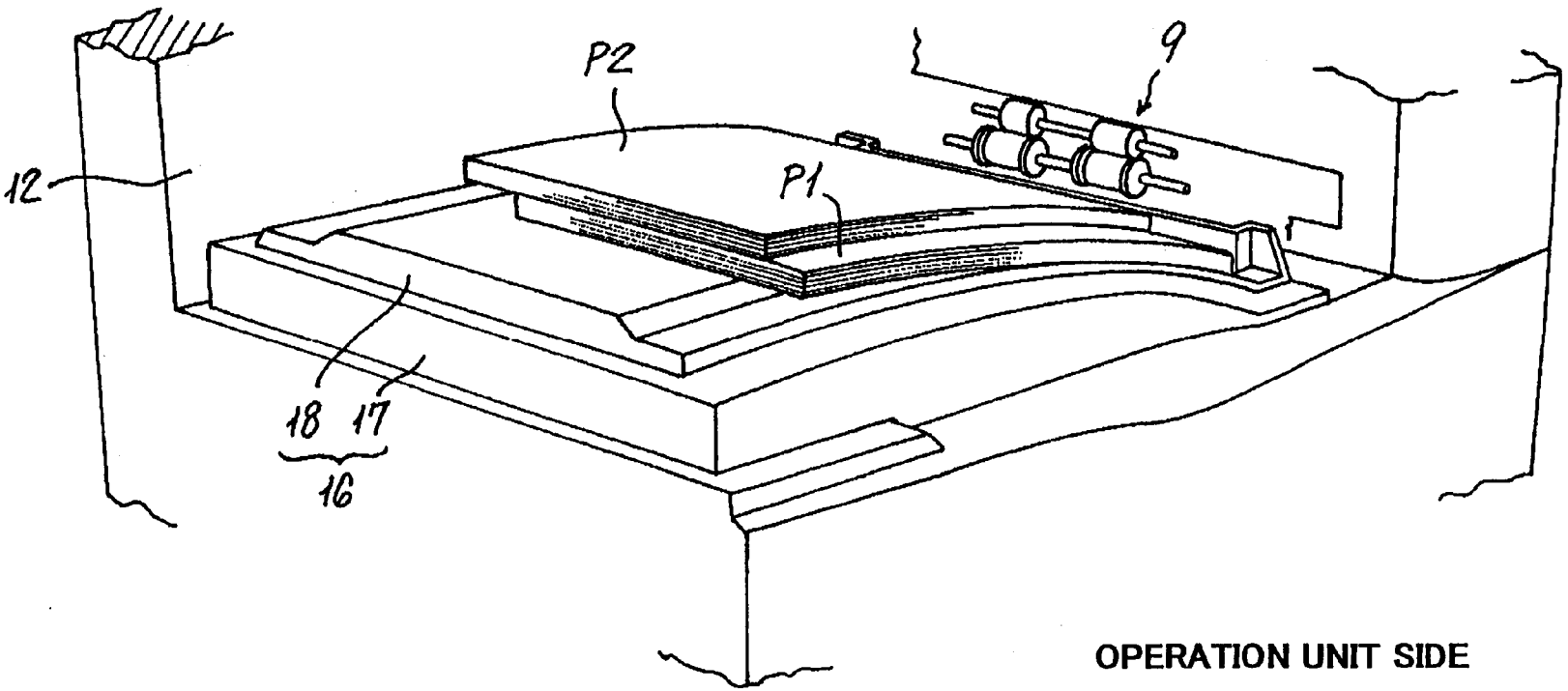
FIG. 5 is a perspective view illustrating the sheet sorting device when sheets are sorted on a movable tray of the sheet sorting device according to an embodiment of the present invention.

Referring to FIG. 2, an image scanning unit 11 is provided on the upper part of the image forming device 4 such that the image scanning unit 11 overhangs the sheet discharging tray 10. Although an illustration is omitted to avoid complexity in FIG. 2, a supporting wall 12 is provided between the image scanning unit 11 and the main body 5 to support the image scanning unit 11 as illustrated in FIGS. 3 through 5. Similarly, the illustration of the supporting wall 12 is omitted in FIGS. 1, 19, 20, and 23 to avoid complexity.

An upper surface of the image scanning unit 11 serves as an original document setting table on which an original document is laid to be scanned. As illustrated in FIG. 4, a pressing board 21 is provided on the above-described upper surface of the image scanning unit 11. Referring to FIG. 2, after an original document is laid on the original document setting table of the image scanning unit 11, a scanner including a movable light 11*a*, a lens 11*b*, and an imaging device 11*c* scans the original document. The scanned information is stored in a central processing unit (CPU) which is described later in FIG. 16. A laser writing device in the main body 5 writes an image on the photoconductive drum of the image forming unit 7 based on the scanned information.

Referring to FIG. 3, a direction perpendicular to the sheet conveying direction A is defined as a B direction (i.e., a direction perpendicular to the paper surface of FIG. 2). Referring to FIGS. 2 and 3, the sheet P fed from the sheet discharging rollers 9 in the sheet conveying direction A falls on the slope 10*a*, and then slides along the slope 10*a* to the upstream side with respect to the sheet conveying direction A. Subsequently, the sheet P halts with the upstream edge of the sheet P abutted against the wall 10*b*. The next discharged sheet P similarly falls on the slope 10*a*, and the sheet P repeatedly stacks on the slope 10*a* in alignment without being sorted.

Referring now to FIG. 4, an end portion of the image scanning unit 11 in the B direction protrudes like eaves, and an operation unit 13 is disposed on the upper surface of the protruding portion of the image scanning unit 11. The operation unit 13 includes switches for operating the sheet discharging apparatus 1 and displays for displaying operational information. Because a sheet post-processing device 39 (described later in FIG. 20) may be attached to the downstream side portion of the main body 5 in the sheet conveying direction A, when an operator takes out the sheets stacked in alignment on the sheet discharging tray 10, the operator usually stands at a position facing the operation unit 13.

In order for the operator to take out easily the sheets stacked on the sheet discharging tray 10, a part of the upper surface of the sheet discharging tray 10 at the operation unit 13 side is hollowed and a concave portion 14 is formed as illustrated in FIG. 3. After a last sheet of the sheets is discharged on the sheet discharging tray 10, the operator can easily grasp the stacked sheets by reaching his/her hand into the concave portion 14.

In the above-described sheet discharging apparatus 1, when the operator needs to sort the sheets discharged from the sheet discharging rollers 9, a sheet sorting device 16 is attached on the sheet discharging tray 10 as illustrated in FIG. 1. Because the sheet sorting device 16 is detachably attached to the sheet discharging tray 10, the sheet sorting device 16 can be easily removed from the sheet discharging tray 10 if necessary. Referring to FIG. 3, a stepped portion 5*a* provided on the horizontal surface 10*c* at the downstream side with respect to the sheet conveying direction A and at the operation unit 13 side is a part of the attaching/detaching device for attaching/detaching a base 17 of the sheet sorting device 16 on/from the sheet discharging tray 10. Further, a stepped screw 15, which is provided on the inner surface of the supporting wall 12 facing the stepped portion 5*a*, is also a part of the attaching/detaching device for the base 17.

Figure 9:
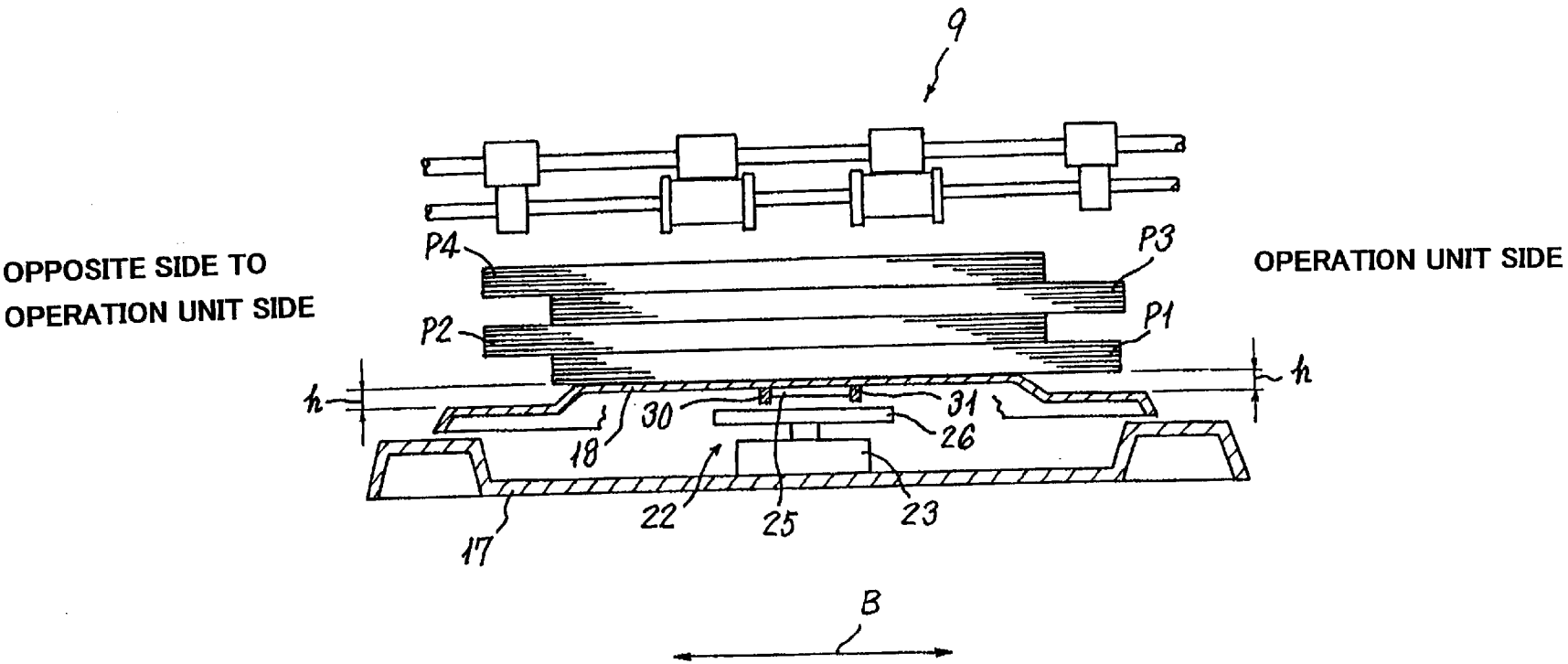
FIG. 9 is a sectional view of the sheet sorting device taken substantially along a line D—D of FIG. 6.

FIGS. 1 and 4 illustrate the sheet discharging apparatus 1 when the sheet sorting device 16 is attached on the sheet discharging tray 10 illustrated in FIGS. 1 and 3. In the sheet sorting device 16 illustrated in FIGS. 1 and 4, a movable tray 18 is provided on the base 17, and a driving device 22 (illustrated in FIG. 10) is provided between the base 17 and the movable tray 18. The base 17, the movable tray 18, and the driving device 22 are integrated with each other in the sheet sorting device 16. Because the base 17 and the movable tray 18 cover the driving device 22 as illustrated in FIG. 9, the driving device 22 is not illustrated in an external view of the sheet discharging apparatus 1 of FIGS. 1 and 4. The driving device 22 allows the movable tray 18 to reciprocate in the reciprocating direction B by a predetermined stroke necessary for sorting sheets.

Figure 6:
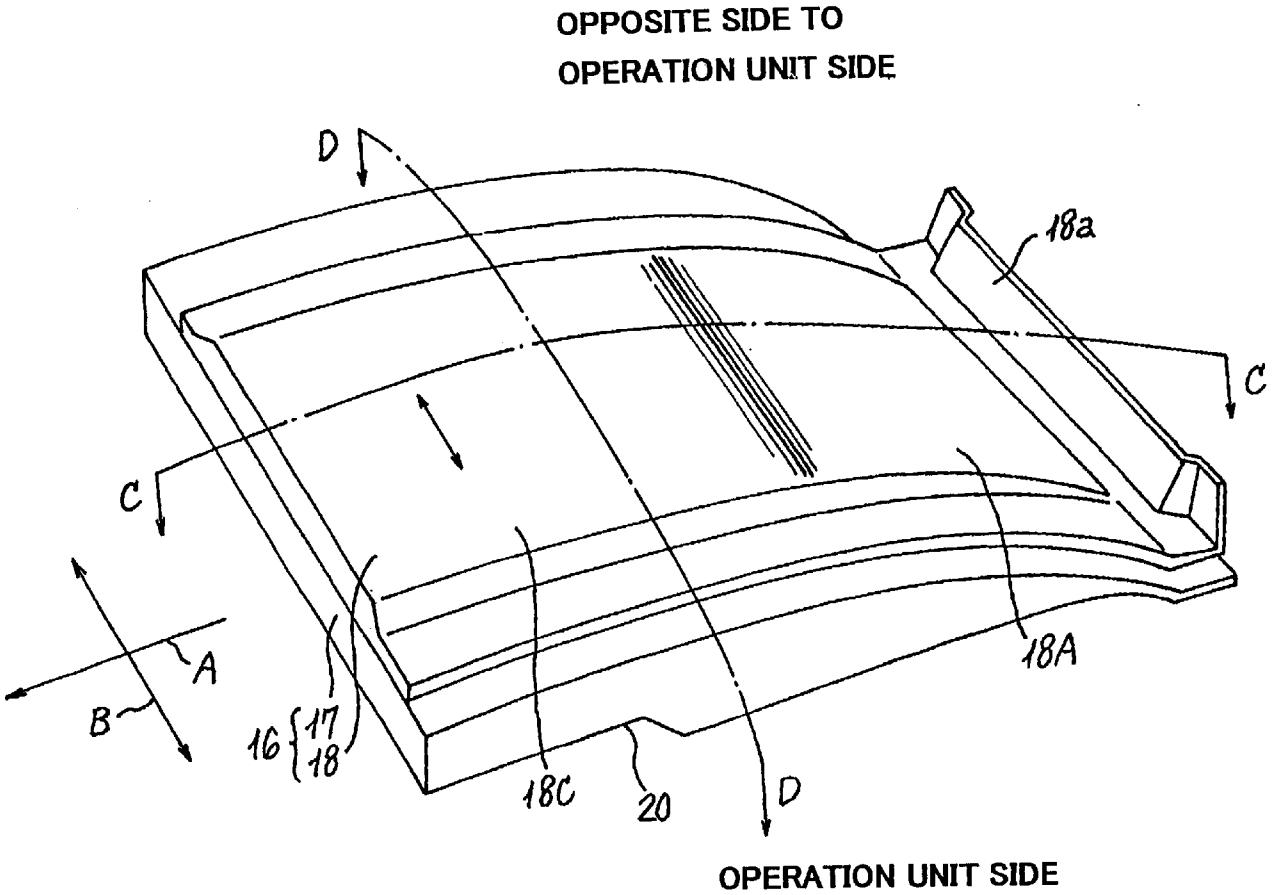
FIG. 6 is a perspective view illustrating the sheet sorting device of the present invention.

FIG. 6 is an external view of the sheet sorting device 16. A wall 18*a* is vertically formed at the upstream end of the movable tray 18 in the sheet conveying direction A. When the sheet sorting device 16 is attached on the sheet discharging tray 10, the wall 18*a* of the movable tray 18 is adjacent and parallel to the wall 10*b* of the sheet discharging tray 10 with respect to the B direction.

Provided on the upper surface of the movable tray 18 are the wall 18*a*, a slope 18A which slopes upward from the bottom part of the wall 18*a* toward the downstream side with respect to the sheet conveying direction A, and a horizontal surface 18C which connects to the downstream end of the slope 18A.

Figure 7:
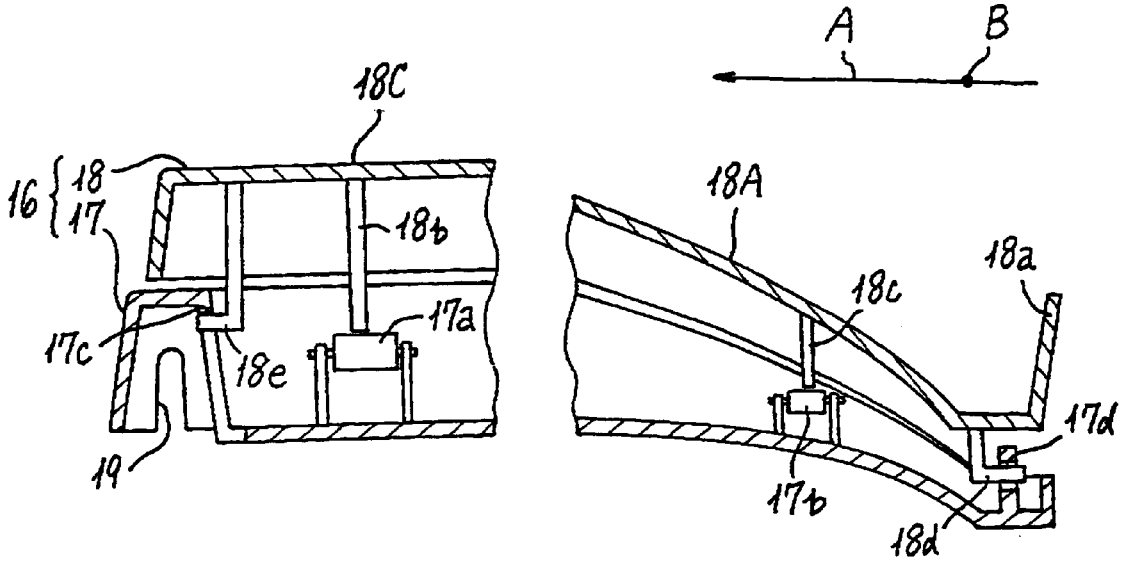
FIG. 7 is a sectional view of the sheet sorting device taken substantially along a line C—C of FIG. 6.

FIG. 7 is a sectional view of the sheet sorting device 16 taken substantially along the line C—C of FIG. 6 which crosses the center part of the sheet sorting device 16 in the B direction. Referring to FIG. 7, on the back side of the movable tray 18, two guide plates 18*b* and 18*c* are integrally provided with the movable tray 18 such that the guide plates 18*b* and 18*c* are spaced apart from each other a predetermined distance and are parallel each other with respect to the B direction (i.e., respective guide plates 18*b* and 18*c* are parallel to the wall 18*a*) . The guide plates 18*b* and 18*c* lengthen in the B direction (i.e., in the direction perpendicular to the paper surface of FIG. 7). The bottom surfaces of guide plates 18*b* and 18*c* abut on rollers 17*a* and 17*b*, respectively, which are rotatably supported by the base 17 of the sheet sorting device 16.

A plurality of rollers 17*a* and 17*b* are provided in the B direction, respectively (i.e., in the direction perpendicular to the paper surface of FIG. 7). The rollers 17*a* and 17*b* are under a load of the movable tray 18 and rotate while the movable tray 18 reciprocating in the B direction to reduce the moving resistance of the movable tray 18.

On the back side of the movable tray 18, guide plates 18*d* and 18*e* are integrally provided with the movable tray 18 such that respective lower portions of the guide plates 18*d* and 18*e* are bent outward in an L-shape. Lower bent portions of the guide plates 18*d* and 18*e* are slidably engaged with guided portions 17*d* and 17*c* formed on the base 17, respectively, to prevent the movable tray 18 from floating and to regulate the movable tray 18 to move only in the B direction.

The above-described regulation of the moving direction of the movable tray 18 enables the movable tray 18 to reciprocate by the driving device 22 including a cam mechanism (described later) and to sort sheets appropriately.

Figure 8:
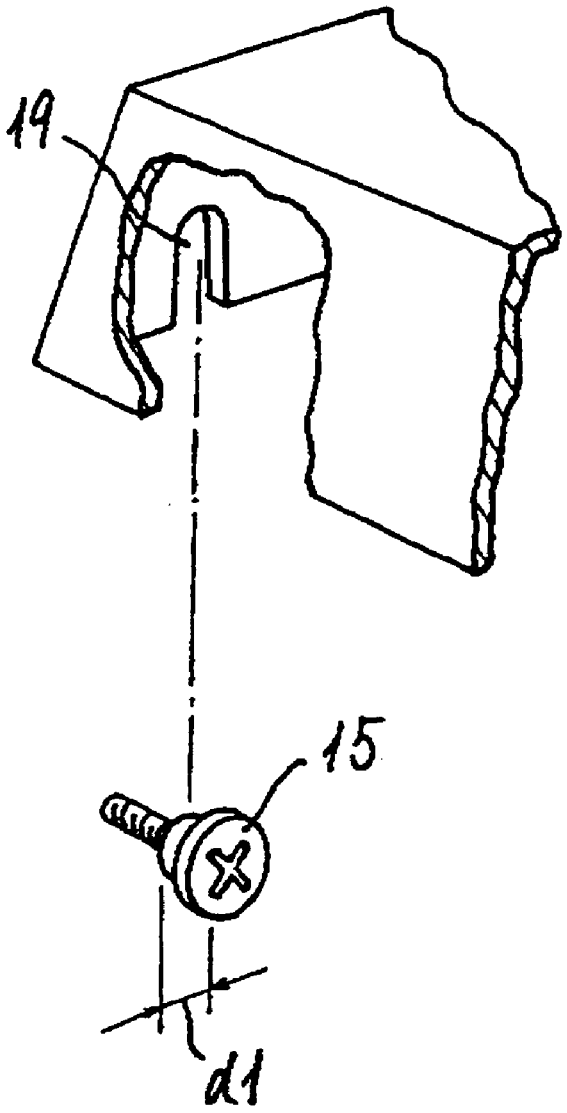
FIG. 8 is a partially sectional view illustrating a part of a base of the sheet sorting device of the present invention.

Referring further to FIG. 7, a concave portion 19 of inverted U-shape wherein an opening directs downward is formed in the side wall of the base 17 at the side opposite to the operation unit 13 side (i.e., the rear side as viewed in FIG. 7) and at the downstream side with respect to the sheet conveying direction A. Referring back to FIG. 6, a stepped cutaway portion 20 is formed in the side wall of the base 17 at the operation unit 13 side (i.e., the front side as viewed in FIG. 6) and at the downstream side with respect to the sheet conveying direction A. As illustrated in FIG. 8, a diameter d1 of the stepped head of the screw 15 is set to be large enough such that the stepped head of the screw 15 is engaged with the concave portion 19.

When the base 17 of the sheet sorting device 16 is attached on the sheet discharging tray 10, the concave portion 19 is engaged with the stepped head of the screw 15 as illustrated in FIG. 8, and the cutaway portion 20 is engaged with the stepped portion 5*a* as illustrated in FIG. 4. By the above-described engagements, the position of the base 17 (i.e., the position of the sheet sorting device 16) is fixed on the sheet discharging tray 10. Respective pairs of the concave portion 19 and the stepped screw 15, and the cutaway portion 20 and the stepped portion 5*a* correspond to a configuration of pair of a concave portion whose opening directs vertically and a convex portion which can be vertically engaged with the concave portion. These pairs of the concave portion 19 and the stepped screw 15, and the cutaway portion 20 and the stepped portion 5*a* constitute an attaching/detaching device by which the base 17 can be easily attached/detached on/from the sheet discharging tray 10 from above, and the position of the base 17 can be easily set.

Owing to the above-described attaching/detaching device, the base 17 (i.e., the sheet sorting device 16) can be easily attached/detached on/from the sheet discharging tray 10 at predetermined positions. By the attaching/detaching device, the sheet sorting device 16 can be attached on the sheet discharging tray 10 at the positions satisfying the conditions such as; the moving direction of the movable tray 18 is perpendicular to the sheet conveying direction; and the sheet sorting device 16 can appropriately receive the sheet P discharged from the sheet discharging rollers 9 with the wall 18*a* of the movable tray 18 being adjacent to the wall 10*b* of the sheet discharging tray 10. Thus, the sheet sorting device 16 can be easily set at predetermined positions where the sheet sorting device 16 can adequately sort sheets.

Because the sheet sorting device 16 is a compact and integral device, the sheet sorting device 16 can be easily attached on the sheet discharging tray 10 with the above-described attaching/detaching device. The sheets are discharged from the sheet discharging rollers 9 on the movable tray 18 when the sheet sorting device 16 is attached.

The process of stacking sheets on the movable tray 18 is similar to the sheet discharging tray 10. Specifically, the sheet P discharged from the sheet discharging rollers 9 falls on the slope 18A. Subsequently, the sheet P slides along the slope 18A by gravity to the upstream side with respect to the sheet conveying direction A until the upstream edge of the sheet P abuts against the wall 18*a*. Then the sheet P halts and stacks in alignment on the movable tray 18.

When the sheets P discharged from the sheet discharging rollers 9 are sorted, the movable tray 18 is preset to move to the side opposite to the operation unit 13 side in the B direction and receives a predetermined number of sheets P at the moved position at the side opposite to the operation unit 13 side. Subsequently, the movable tray 18 is moved to the operation unit 13 side in the B direction and receives a predetermined number of sheets P at the moved position at the operation unit 13 side. By movement of the movable tray 18 between the above-described two positions, the sheets P can be sorted on the movable tray 18 by a group of predetermined number of sheets. The condition of the sorted sheets P is illustrated in FIGS. 5 and 9.

Referring to FIGS. 5 and 9, when the first group of sorted sheets is represented by P1, and the second group of sorted sheets is represented by P2, the group of sorted sheets continues on P3, P4, and so on. The sorted sheets of each group are stacked on the movable tray 18 with the trailing edge of the sheets adequately aligned by the wall 18*a*.

The wall 18*a* of the movable tray 18 is positioned adjacent to the wall 10*b* of the sheet discharging tray 10. Because the movable tray 18 receives the sheets discharged from the sheet discharging rollers 9 on the sheet discharging tray 10, the sheet conveying distance to the movable tray 18 is substantially the same as one to the sheet discharging tray 10. As compared to the above-described background sheet post-processing apparatus wherein the sheet sorting device is provided at a position some distance from the sheet receiving rollers, the sheet conveying distance from the sheet discharging rollers 9 to the sheet sorting device 16 is reduced in this embodiment. Consequently, the time for sheet sorting process can be reduced.

FIG. 9 is a sectional view of the sheet sorting device 16 taken substantially along the line D—D of FIG. 6 which crosses the position where the driving device 22 is provided. Referring to FIG. 9, the driving device 22 is provided at substantially the center part of the movable tray 18 in the B direction which is perpendicular to the sheet conveying direction A. Further, because the driving device 22 is high to some extent in the vertical direction, the driving device 22 is positioned under the horizontal surface 18C which is higher than the other portions of the movable tray 18, and is positioned at substantially the center part of the movable tray 18 in the B direction. As far as the driving device 22 is positioned at substantially the center part of the movable tray 18 in the B direction, it is no problem for the movable tray 18 to receive the sheet P if the side end portion of the movable tray 18 at least at the operation unit 13 side in the B direction is made lower than the center part of the movable tray 18.

In this embodiment, the side end portions of the movable tray 18 in the B direction at both the operation unit 13 side and the side opposite to the operation unit 13 side are made lower than the center part of the movable tray 18 by a height "h" as illustrated in FIG. 9. Because the supporting wall 12 stands at the side opposite to the operation unit 13 side, the operator can take out the sheets on the movable tray 18 only from the operation unit 13 side. Owing to the above-described stepped portion of the movable tray 18 at the operation unit 13 side which is lower than the center part of the movable tray 18 by the height "h", the operator can easily take out the sheets P on the movable tray 18 by reaching his/her hands into the above-described stepped portion.

If the driving device 22 is provided at the operation unit 13 side instead of the above-described center part of the movable tray 18 in the B direction, the above-described stepped portion for the convenience of taking out sheets needs to be provided at the position closer to the operation unit 13 side. As a result, the size of the sheet discharging apparatus increases as a whole. Therefore, because the driving device 22 is provided at the center part of the movable tray 18 in the B direction in this embodiment, the stepped portion can be provided without expanding the width of the movable tray 18 in the B direction and without increasing the size of the sheet discharging apparatus.

Figure 10:
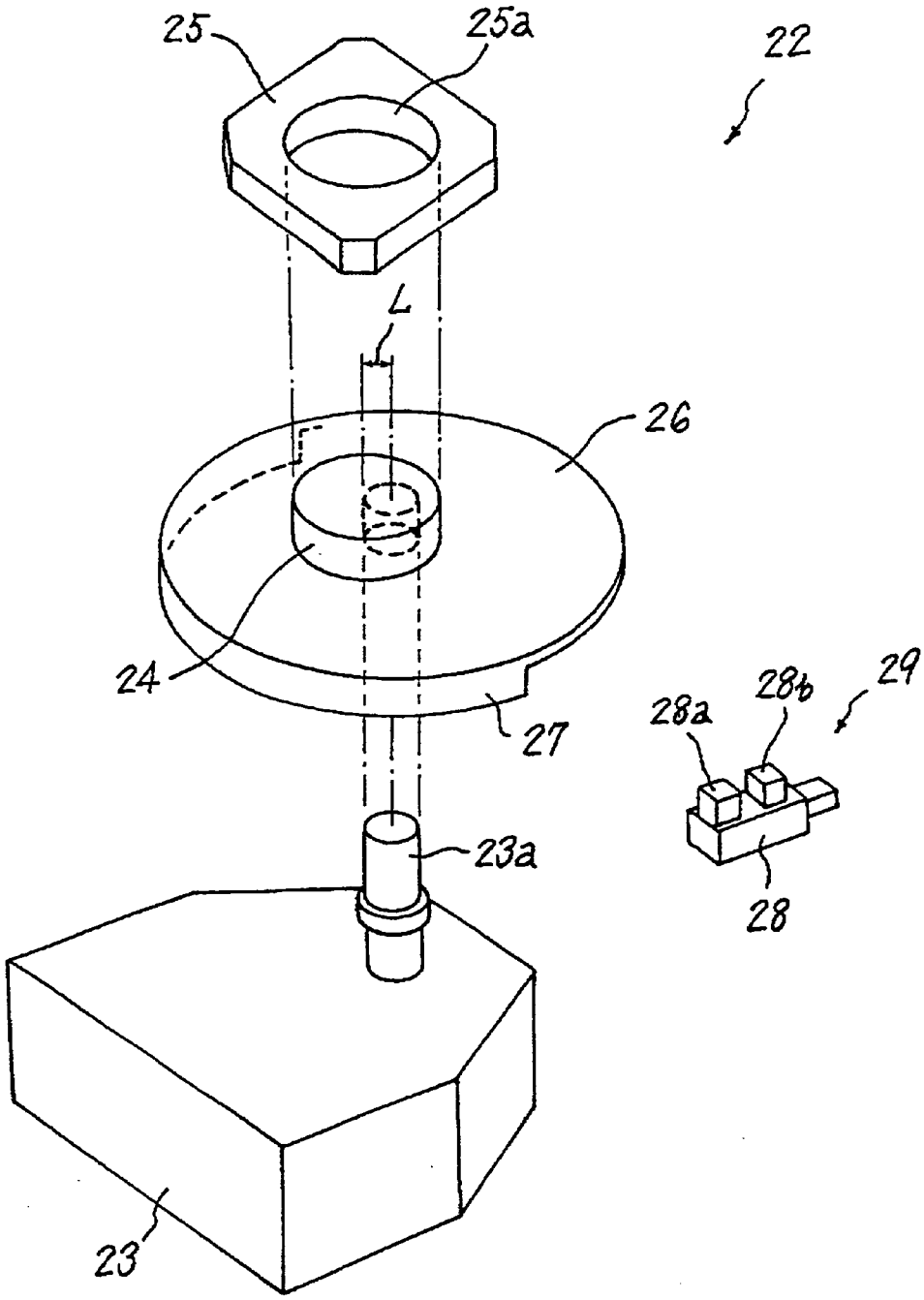
FIG. 10 is an exploded perspective view illustrating a driving device of the sheet sorting device of the present invention.

Next, the driving device 22 is described. Referring to FIGS. 9 and 10, the driving device 22 includes a cam device provided with the base 17 and guide members integrally provided with the movable tray 18. The cam device includes main elements, such as a motor 23, a cam 24 of disk-like shape, and a sliding member 25. A rotatable body 26 of disk-like shape is integrally provided with the cam 24, and rotates in synchronism with reciprocating motions of the movable tray 18.

The motor 23 is fixed on the base 17 at the center part thereof in the B direction. A rotation shaft 23*a* of the motor 23 is engaged and fixed with the cam 24 at a position eccentric away from the center of the cam 24 by eccentricity indicated by reference letter L in FIG. 10.

The center of the rotatable body 26 is coincident with the center of the rotating shaft 23*a*. A mask plate 27 is provided along the halfway periphery of the rotatable body 26. A sensor 28 includes a light-emitting unit 28*a* and a light-receiving unit 28*b* which face each other and are spaced at a predetermined distance apart. The sensor 28 is fixed to a stationary member (e.g., the base 17) such that the mask plate 27 is situated between the light-emitting unit 28*a* and the light-receiving unit 28*b*.

A detecting device 29 includes the mask plate 27 and the sensor 28. The detecting device 29 detects a reciprocating position of the movable tray 18. The sliding member 25 is plate-shaped having at least one pair of sides which face each other in parallel. In this embodiment, the sliding member 25 may be a square plate-shaped member having a hole 25*a* at the center thereof. The cam 24 is slidably and rotatably engaged with the hole 25*a*, and thereby the sliding member 25 supports the cam 24.

Figure 11B:
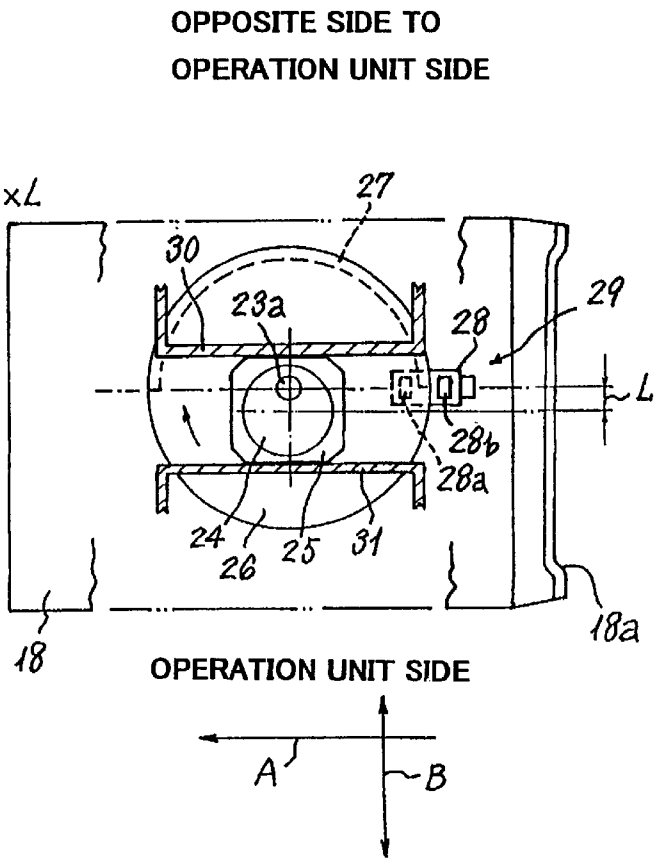
FIG. 11B is a partially sectional view of the movable tray when the movable tray is positioned at a side opposite to an operation unit side according to an embodiment of the present invention.
Figure 11A:
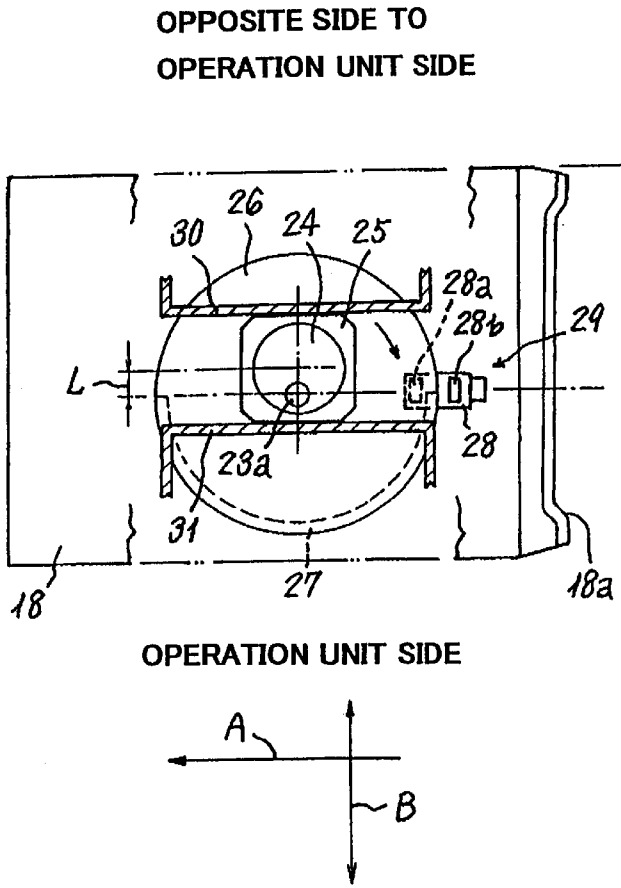
FIG. 11A is a partially sectional view of the movable tray when the movable tray is positioned at a side of an operation unit.

As illustrated in FIGS. 9, 11A, and 11B, ribs 30 and 31 as guiding members are formed in parallel with respect to the sheet conveying direction A at the back side of the movable tray 18. The sliding member 25 is slidably engaged between the ribs 30 and 31.

As described in FIG. 7, the movable tray 18 of the sheet sorting device 16 includes the guide plates 18*b*/18*c* and the guided portions 17*c*/17*d*, and is regulated to move only in the B direction. When the motor 23 is rotated in an arbitrary one direction, the sliding member 25 slides along the ribs 30 and 31. As a result, the movable tray 18 can reciprocate in the reciprocating direction B by a stroke of double eccentricity L as illustrated in FIGS. 11A and 11B. Owing to the mechanism wherein the eccentric cam 24 is connected to the motor 23, the movable tray 18 can reciprocate without employing a device such as a reversible roller which needs a complicated control mechanism.

Figure 12:
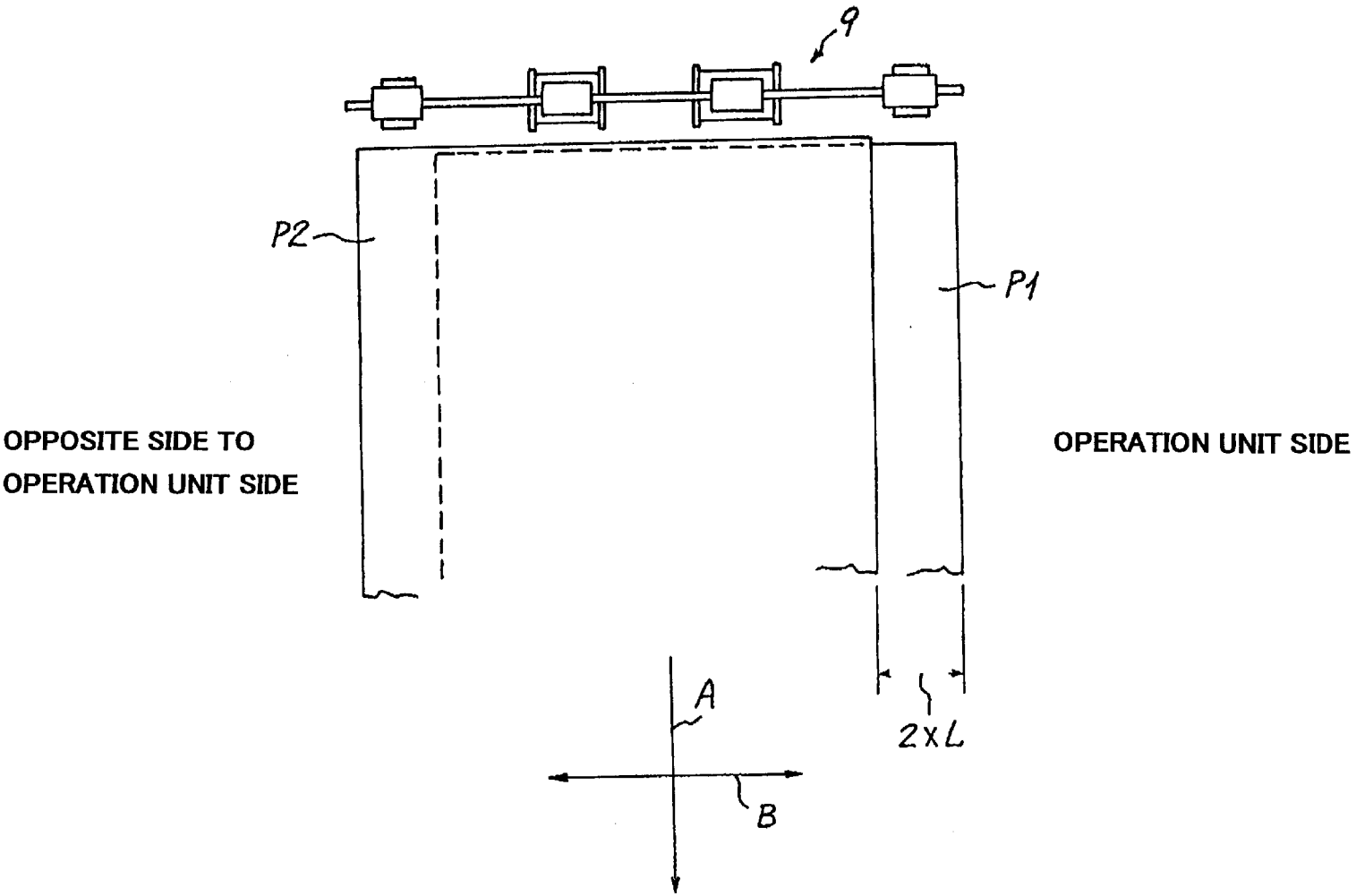
FIG. 12 is a plan view of the movable tray as viewed from above when sheets are sorted into plural sets on the movable tray according to an embodiment of the present invention.

As illustrated in FIG. 12, when the movable tray 18 reciprocates in the manner as described above, the shift distance between the first group of sorted sheets P1 and the second group of sorted sheets P2 amounts to 2×L (i.e., double eccentricity L).

Referring to FIG. 4, the operator takes out the sheets stacked on the movable tray 18 only from the operation unit 13 side, because the supporting wall 12 stands at the side opposite to the operation unit 13 side, and the image forming device 4 and the sheet post-processing device 39 (see FIG. 20) are provided upstream and downstream of the movable tray 18 in the sheet conveying direction A, respectively. As described in FIG. 9, in order for the operator to take out easily the sheets on the movable tray 18, the stepped portion which is lower than the center part of the movable tray 18 by the height "h" is provided at the operation unit 13 side of the movable tray 18.

In accordance with the above-described configuration, it is easy for the operator to take out the sorted sheets if the movable tray 18 after finishing sorting the sheets is controlled to halt at the operation unit 13 side. In addition, if the movable tray 18 is controlled to receive a first sheet of the sheets at the side opposite to the operation unit 13 side, the operator can easily grasp the whole sets of sorted sheets just by grasping the bottom first group of sorted sheets P1 which is situated at the operation unit 13 side as illustrated in FIGS. 5, 9, and 12.

A control device provided inside the main body 5 and the detecting device 29 control the positioning of the movable tray 18. The control device includes a central processing unit (CPU) 32 illustrated in FIG. 16. The CPU 32 totally controls the sheet discharging apparatus 1, the sheet sorting device 16, and other devices. Specifically, the CPU 32 controls to receive data from a read only memory (ROM) 33, send/receive information to/from a random-access memory (RAM) 34, and receive signals from the sensor 28 and a connector 40. The CPU 32 further controls to display and switch operational information on the operation unit 13 in accordance with instructions from the operation unit 13, such as a number of original documents, a number of copies, a non-sorting mode, a sort mode, a stack mode, a staple mode, and etc. The CPU 32 controls to send input information from outside relevant to the positioning of the movable tray 18 to the driving device 22, and to drive the motor 23.

Referring to FIGS. 11A and 11B, the cam 24 and the rotatable body 26 rotate in the clockwise direction as indicated by an arrow. FIG. 11A illustrates a condition immediately after the mask plate 27 passes between the light-emitting unit 28*a* and the light-receiving unit 28*b* of the sensor 28, i.e., a condition when the light-receiving unit 28*b* is switched from ON to OFF state. In this condition, the rotational position of the cam 24 is adjusted such that the movable tray 18 is positioned at most close to the operation unit 13 side.

FIG. 11B illustrates a condition when the mask plate 27 is positioned immediately before the sensor 28, i.e., a condition when the light-receiving unit 28*b* is switched from OFF to ON state. In this condition, the rotational position of the cam 24 is adjusted such that the movable tray 18 is positioned at most close to the side opposite to the operation unit 13 side.

Accordingly, it can easily judge by the CPU 32 based on the ON/OFF switch condition of the sensor 28 whether the movable tray 18 is positioned at the operation unit 13 side or the side opposite to the operation unit 13 side. Because the CPU 32 recognizes an image forming processing condition based on the input information from the operation unit 13, the CPU 32 recognizes the completion of the sheet sorting operation by the movable tray 18. Judging from the above-described all related information, the CPU 32 can control the movable tray 18 after finishing sorting the sheets to halt at the operation unit 13 side. Similarly, the CPU 32 can control the movable tray 18 to receive the first sheet of the sheets at the side opposite to the operation unit 13 side.

In this embodiment, when the sheets are sorted by the sheet sorting device 16, the position where the movable tray 18 receives the sheets is higher than the position where the sheet discharging tray 10 receives the sheets, because the sheet sorting device 16 is attached on the sheet discharging tray 10 and the position of the sheet discharging rollers 9 is not changed. As a result, the sheets may not be stacked on the movable tray 18 in proper alignment, because the sheets discharged from the sheet discharging rollers 9 may not smoothly slide on the slope 18A and the upstream edge of the sheets in the sheet conveying direction A may not abut against the wall 18*a*.

Figure 13:
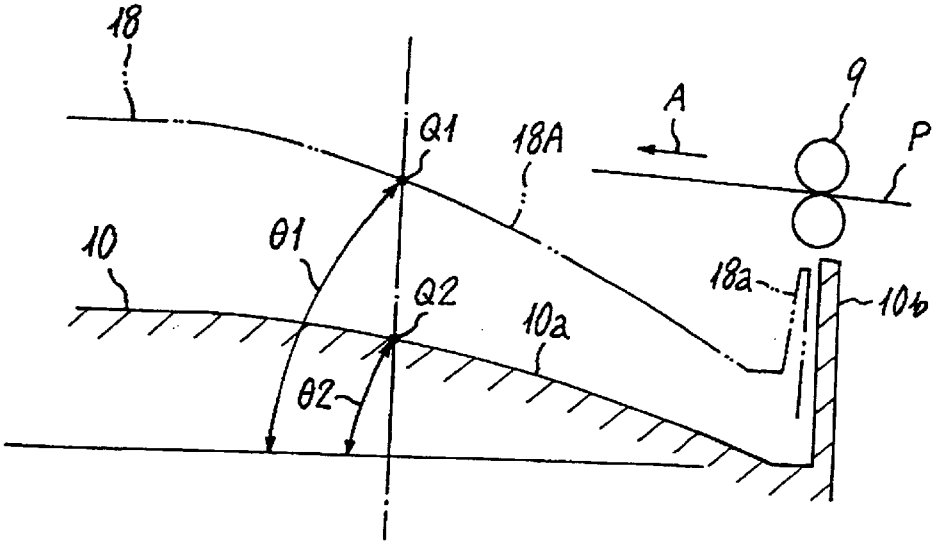
FIG. 13 is an explanatory view for a comparison of an angle of a slope of the movable tray with an angle of a slope of the sheet discharging tray.

Through various experiments, as illustrated in FIG. 13, the inventors have set an angle θ1 of the slope 18A of the movable tray 18 at an arbitrary position Q1 of the slope 18A greater than an angle θ2 of the slope 10*a* of the sheet discharging tray 10 at an arbitrary position Q2 of the slope 10*a* corresponding to the arbitrary position Q1. By setting the angles of the slopes as described above, the sheets can be stacked on the movable tray 18 in proper alignment even though the position where the movable tray 18 receives the sheets is higher than the position where the sheet discharging tray 10 receives the sheets.

In this embodiment, when the sheet sorting device 16 is attached on the sheet discharging tray 10, the wall 18*a* of the movable tray 18 stands downstream of the wall 10*b* of the sheet discharging tray 10 in the sheet conveying direction A. Consequently, even though the wall 10*b* of the sheet discharging tray 10 is set at an optimal position (i.e., immediately below the sheet discharging rollers 9) in view of arrangements with the sheet discharging rollers 9, the trailing edge of the sheets may not be able to overpass the wall 18*a* and may remain on the wall 18*a* depending on sheet sizes. As a result, the sheets may not be adequately aligned on the movable tray 18.

Figure 14:
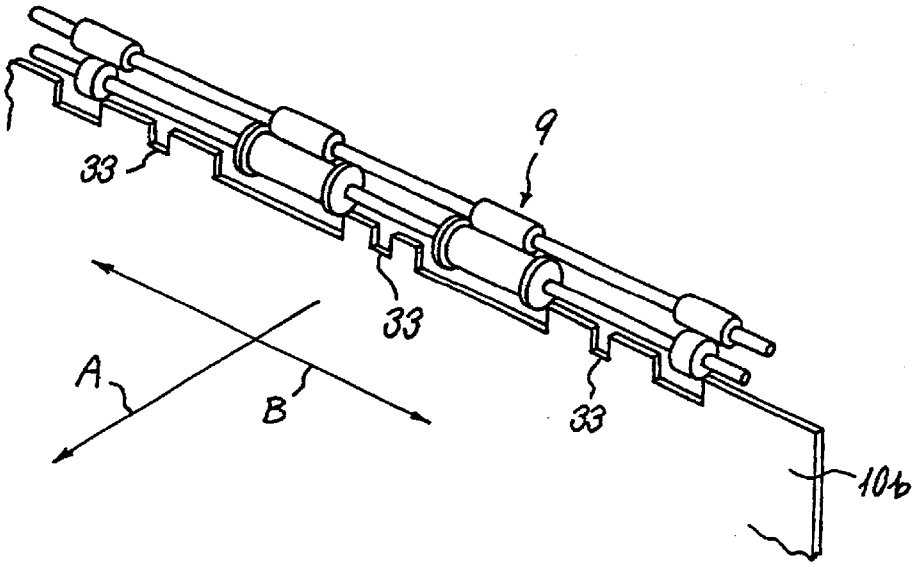
FIG. 14 is a perspective view illustrating sheet discharging rollers and a wall of the sheet discharging apparatus of the present invention.
Figure 15:
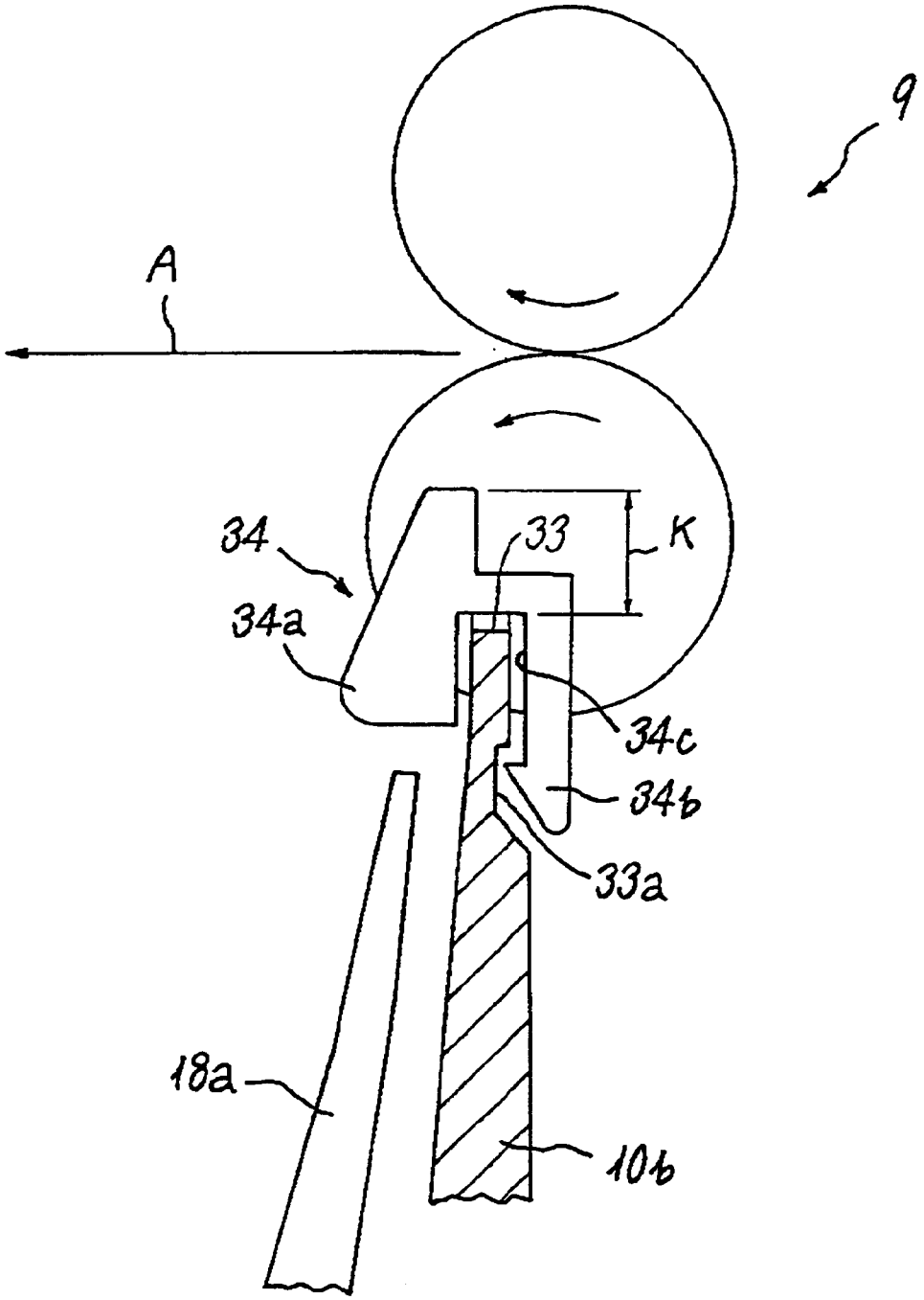
FIG. 15 is a sectional view illustrating a guide member which is detachably attached to the wall of the sheet discharging tray of the present invention.

In order to ensure that the sheets can be discharged to the movable tray 18 over the wall 18*a*, as illustrated in FIG. 14, cutaway portions 33 are formed at three places of the wall 10*b* in the B direction so as to attach attachable/detachable guide members 34 on the cutaway portions 33. The cutaway portion 33 is formed in view of the ease of the attachment of the guide member 34 on the wall 10*b*. As illustrated in FIG. 15, the guide member 34 includes a slot 34*c* for engagement, a guide portion 34*a*, and a click portion 34*b* that faces the guide portion 34*a* over the slot 34*c*.

When the guide member 34 is attached on the cutaway portion 33, the slot 34*c* is engaged with the cutaway portion 33, and the click portion 34*b* is engaged by use of its elasticity with a concave portion 33*a* formed on the wall 10*b* below the cutaway portion 33. By these engagements, the guide portion 34*a* covers the upper portion of the wall 10*b* above the upper end portion of the wall 18*a*.

The guide portion 34*a* overhangs the wall 18*a* and includes a guiding surface steeply slanting downward toward the left side as viewed in FIG. 15 at the downstream side surface of the guide portion 34*a* in the sheet conveying direction A. The guiding surface of the guide portion 34*a* is located downstream of the wall 18*a* in the sheet conveying direction A, and guides the trailing edge of the sheets in the sheet conveying direction A over the wall 18*a*. When the guide member 34 is attached on the cutaway portion 33 of the wall 10*b*, it is configured that the top of the guide member 34 is higher than the bottom of the cutaway portion 33 by a height indicated by reference letter K in FIG. 15 in order to align the top of the guide member 34 with the top of the wall 10*b* where the cutaway portions 33 are not formed.

As described above, when the sheet sorting device 16 is attached on the sheet discharging tray 10, the guide member 34 is also attached on the cutaway portion 33 of the wall 10*b*. By attaching the guide member 34 on the wall 10*b*, the trailing edge of the sheets of various sizes discharged from the sheet discharging rollers 9 can be adequately guided to the downstream side of the wall 18*a* in the sheet conveying direction A. As a result, the sheets are stacked on the movable tray 18 of the sheet sorting device 16 in alignment. It is possible to attach/detach the guide member 34 on/from the wall 10*b* if necessary.

In the above-described sheet discharging apparatus 1, because the sheet sorting device 16 can be easily attached on the sheet discharging tray 10, the sheet sorting operation can be performed in a compact and space saving configuration.

Figure 19:
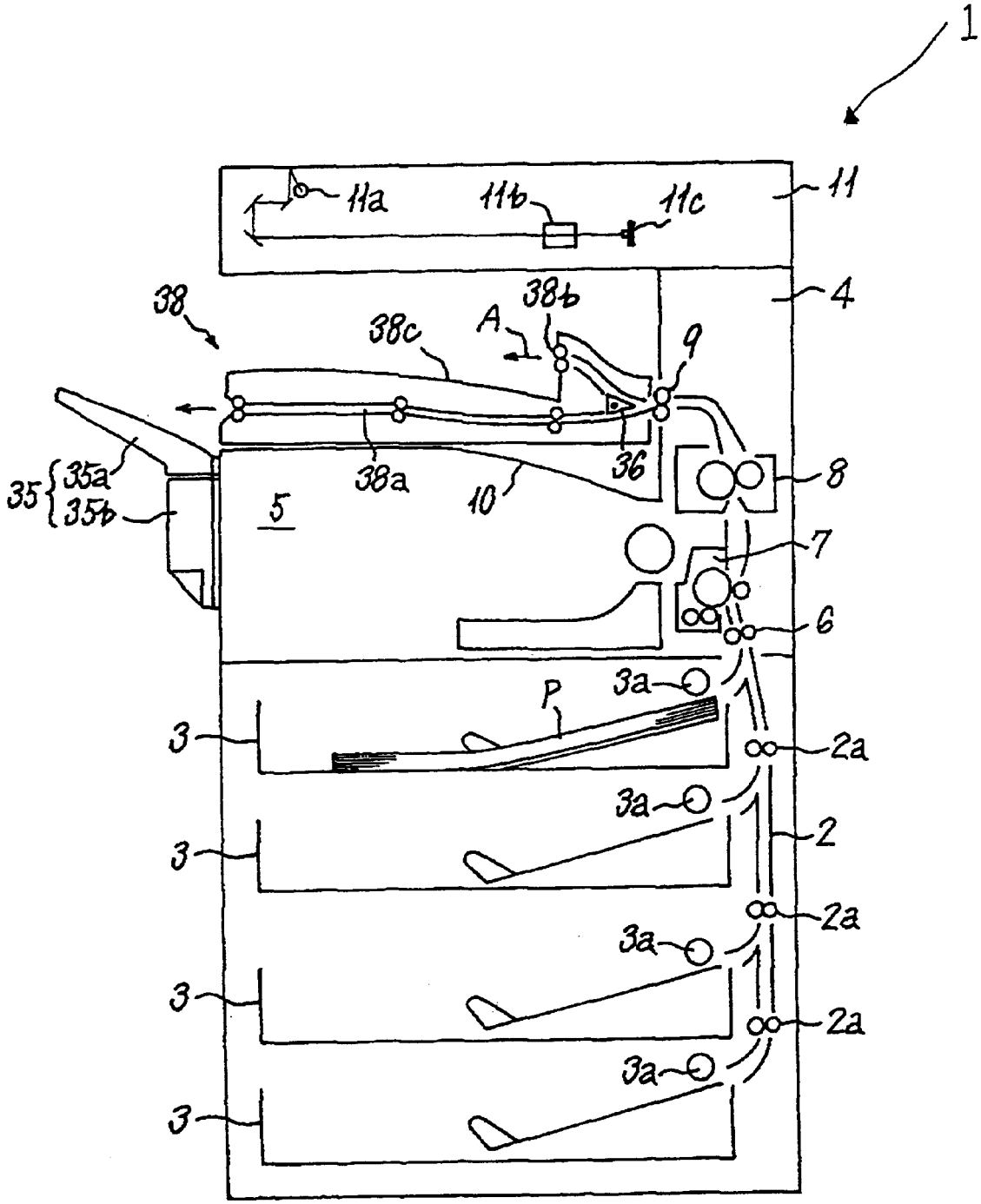
FIG. 19 is a schematic view illustrating an overall construction of a sheet discharging apparatus to which a second sheet sorting device is attached according to another embodiment of the present invention.
Figure 20:
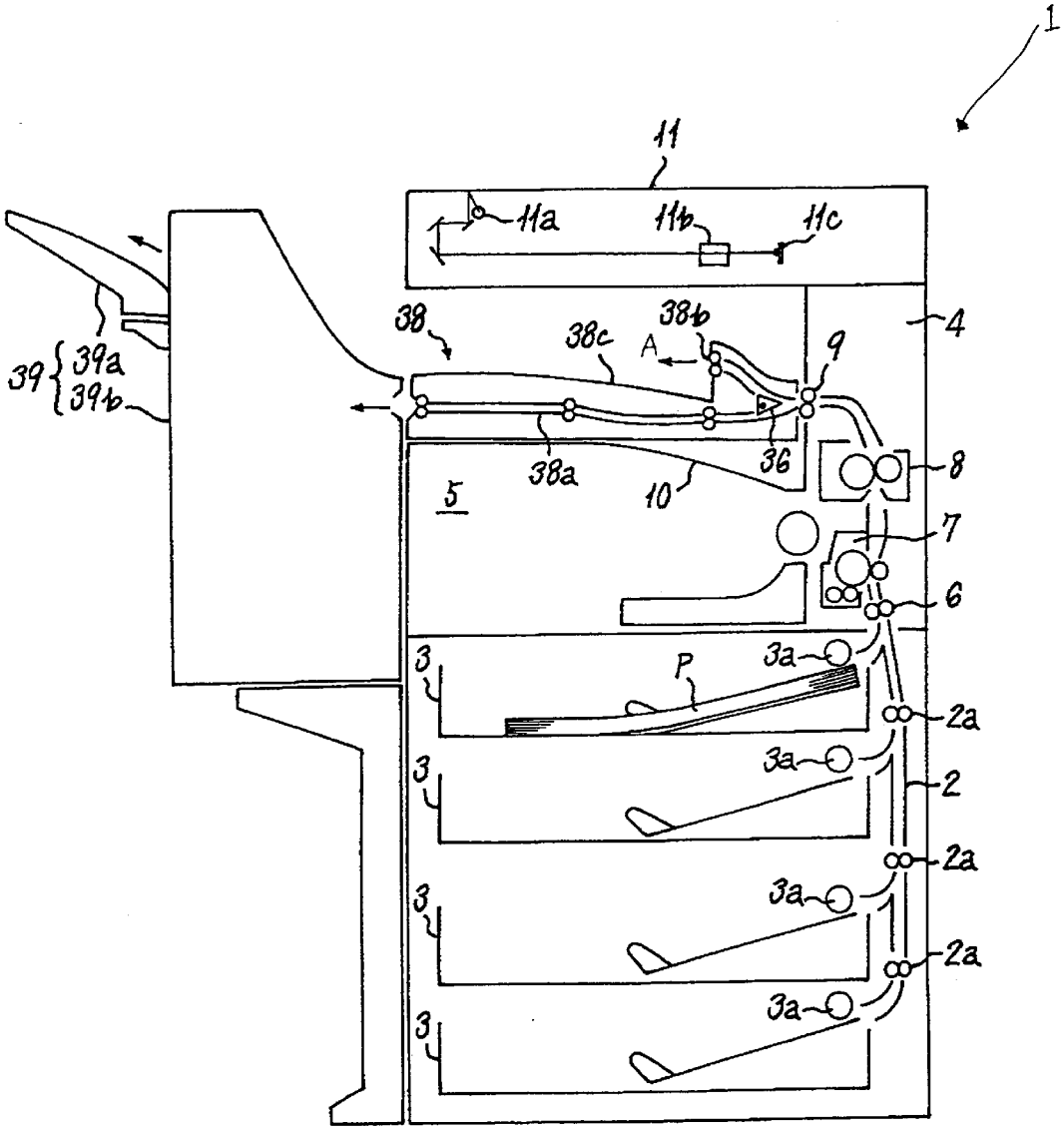
FIG. 20 is a schematic view illustrating an overall construction of a sheet discharging apparatus to which a sheet post-processing device is attached according to another embodiment of the present invention.

Next, the sheet discharging apparatus 1 according to another embodiment is described. As seen from FIGS. 1 and 2, because the image scanning unit 11 overhangs the sheet sorting device 16 in the sheet discharging apparatus 1, the stacking capacity of the movable tray 18 for the sorted sheets is limited. In another embodiment, in order to stack a large amount of sorted sheets on a tray and to perform additional functions such as a stapling function, an alternative sheet discharging device can be attached downstream of the main body 5 in the sheet conveying direction A. As the above-described sheet discharging device, a second sheet sorting device having a sheet sorting function and a sheet post-processing device having sheet sorting and stapling functions can be employed. FIG. 19 illustrates the sheet discharging apparatus 1 to which the second sheet sorting device is attached, and FIG. 20 illustrates the sheet discharging apparatus 1 to which the sheet post-processing device is attached. When the operator needs to sort a large number of sheets, a second sheet sorting device 35 is attached to the sheet discharging apparatus 1. When the operator needs the stapling function, a sheet post-processing device 39 is attached to the sheet discharging apparatus 1.

Hereinafter, the sheet discharging apparatus 1 illustrated in FIG. 19 is described. The second sheet sorting device 35 is attachable/detachable to/from the sheet discharging apparatus 1 at the downstream side end of the main body 5 in the sheet conveying direction A. The second sheet sorting device 35 includes a movable tray 35*a*, a shift mechanism 35*b*, and a moving up and down mechanism (not shown). The movable tray 35*a* sorts the sheets by reciprocating in the B direction perpendicular to the sheet conveying direction A by a predetermined stroke. The shift mechanism 35*b* drives the movable tray 35*a*. The moving up and down mechanism moves up and down the movable tray 35*a* according to the amount of sheets stacked on the movable tray 35*a*. The driving device described in FIGS. 10 and 11 or alternative shift mechanisms can be employed as the shift mechanism 35*b*. Because the movable tray 35*a* can move up and down, a larger amount of sheets can be stacked on the movable tray 35*a* than the movable tray 18 of the sheet sorting device 16.

When the second sheet sorting device 35 is attached at the downstream side end of the main body 5 in the sheet conveying direction A, a sheet relaying device 38 is attached on the sheet discharging tray 10 in place of the sheet sorting device 16. The main function of the sheet relaying device 38 is to relay the sheets discharged from the sheet discharging rollers 9 to the second sheet sorting device 35. As a sub function, the sheet relaying device 38 stacks the sheets thereon.

The sheets discharged from the sheet discharging rollers 9 are switched to direct into two directions by a separation pick 36 in the sheet relaying device 38. In one direction, the sheets are conveyed to the movable tray 35*a* via a sheet conveying path 38*a* on which sheet conveying rollers are provided. In another direction, the sheets are conveyed to a sheet discharging tray 38*c* without a sheet shifting function via a pair of second sheet discharging rollers 38*b*.

Referring next to FIG. 20, the sheet post-processing apparatus 39 is attachable/detachable to/from the sheet discharging apparatus 1 at the downstream side end of the main body 5 in the sheet conveying direction A. The sheet post-processing device 39 includes a sheet discharging tray 39*a* which moves up and down according to the amount of sheets stacked thereon, and a sheet processing device 39*b* having a stapling device which staples a bunch of sheets. Further, the sheet discharging tray 39*a* sorts sheets which are conveyed through the sheet processing device 39*b* by reciprocating in the direction perpendicular to the sheet conveying direction A by a predetermined stroke.

When the sheet post-processing apparatus 39 is attached at the downstream side end of the main body 5 in the sheet conveying direction A, the sheet relaying device 38 is attached on the sheet discharging tray 10. As described above, the sheets discharged from the sheet discharging rollers 9 are switched to direct to the sheet post-processing device 39 or to the sheet discharging tray 38*c* by the separation pick 36.

In the above-described another embodiment, an attaching/detaching device which attaches/detaches the sheet relaying device 38 on/from the sheet discharging tray 10 at proper positions is similar to the one used to attach/detach the sheet sorting device 16 on/from the sheet discharging tray 10. That is, the sheet relaying device 38 is attached on the sheet discharging tray 10 by using the stepped portion 5*a* and the stepped screw 15 illustrated in FIG. 3.

As described above, the sheet discharging apparatus 1 discharges the sheets in four conditions wherein (1) the sheet discharging tray 10 is used, (2) the sheet sorting device 16 is attached on the sheet discharging tray 10, (3) the sheet relaying device 38 and the second sheet sorting device 35 are attached, and (4) the sheet relaying device 38 and the sheet post-processing device 39 are attached. Depending on the above-described conditions, the operational information displayed in the operation unit 13 is changed.

In the case of condition (1), the CPU 32 recognizes that the sheet sorting device 16 and the sheet relaying device 38 are not attached on the sheet discharging tray 10. As a result, the CPU 32 controls not to display the operational information of sorting and stapling on the operation unit 13. In the case of condition (2), the CPU 32 recognizes that the sheet sorting device 16 is attached on the sheet discharging tray 10, and controls to display the operational information of sorting on the operation unit 13. In the case of condition (3), the CPU 32 recognizes that the sheet relaying device 38 and the second sheet sorting device 35 are attached to the sheet discharging apparatus 1, and controls to display the operational information of sorting on the operation unit 13. In the case of condition (4), the CPU 32 recognizes that the sheet relaying device 38 and the sheet post-processing device 39 are attached to the sheet discharging apparatus 1, and controls to display the operational information of sorting and stapling on the operation unit 13.

Figure 21:
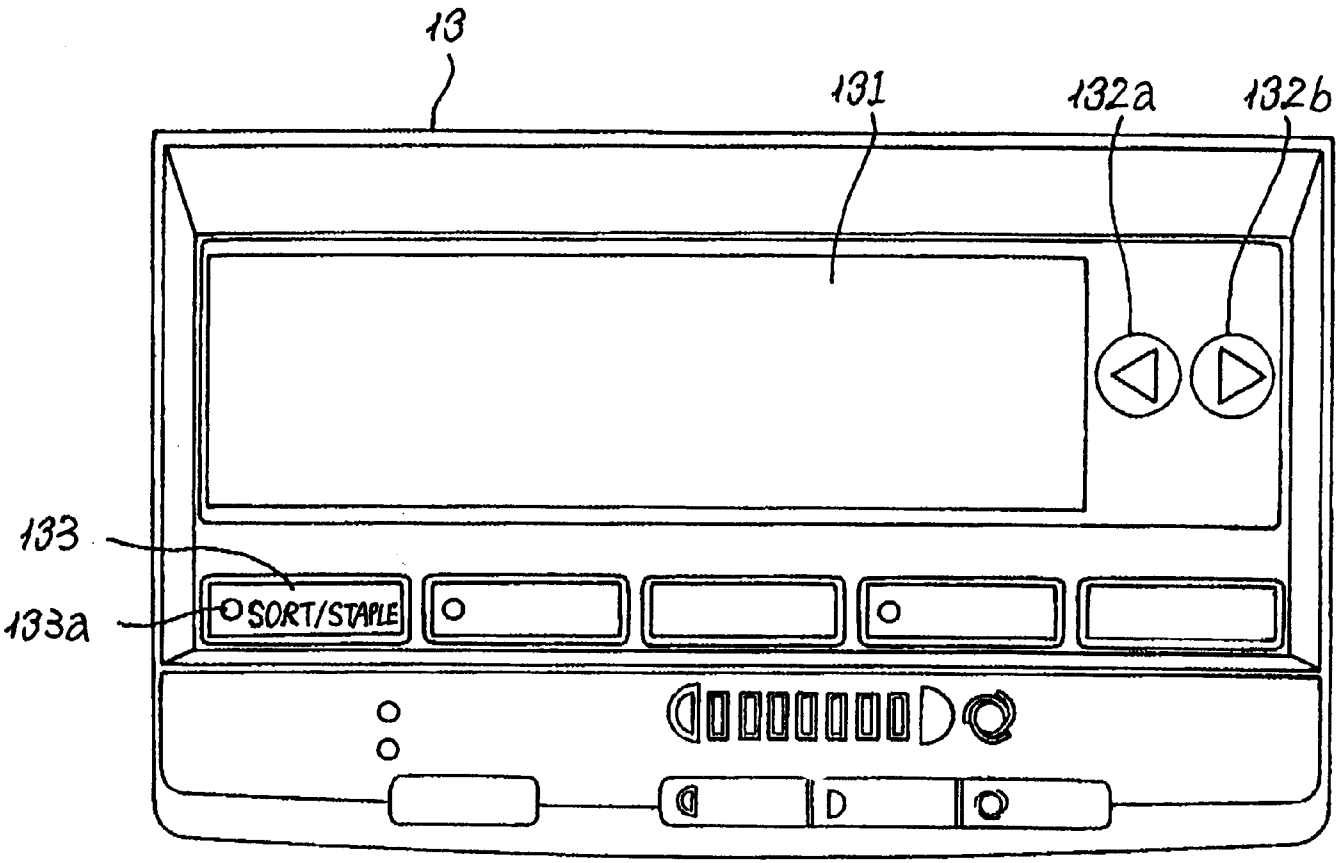
FIG. 21 is a plan view illustrating an operation unit.

Referring to FIGS. 21 and 22, how the operational information is displayed on the operation unit 13 is described. In FIG. 21, the operation unit 13 of FIG. 4 is enlarged. The operation unit 13 includes an LCD (Liquid Crystal Display) panel 131, and touch switches 132*a* and 132*b* displayed at the right side of the LCD panel 131. The touch switches 132*a* and 132*b* have displays of arrows, respectively, which direct to opposite directions.

A sort/staple selection key 133 is provided below the LCD panel 131 and at the left side portion of the operation unit 13 to select either one of a sort mode, a stack mode, and a staple mode. In the sort mode, the sheets are sorted by a set of sheets of successive page numbers. In the stack mode, the sheets are sorted by a set of sheets of the same page number. On the surface of the sort/staple selection key 133, a light-emitting display section 133*a* of a light-emitting diode (LED) is provided, and the letters of "sort/staple" are printed. Furthermore, a duplex mode key, an enlarge/reduce key, an auto reduce/enlarge key, and a full size key are arranged at the right side of the sort/staple selection key 133, and an image density adjusting key is arranged at the bottom portion of the operation unit 13.

In the case of the above-described condition (1), the LCD panel 131 displays the standard operational information for image forming operations. The standard operational information is, for example, number keys, the number of copies, a sheet size, the rate of enlarge/reduce, etc. In the case of condition (1), the sort/staple selection key 133 is not responsive, and the light-emitting display section 133*a* is kept unlighted. Therefore, even if the sort/staple selection key 133 is pressed, the display of the standard operational information on the LCD panel 131 is not changed.

In the case of conditions (2) and (3), the sort/staple selection key 133 is active and the light-emitting display section 133*a* is lighted. The LCD panel 131 switches from the display of standard operational information to the display as illustrated in FIG. 22A.

Figure 22A:
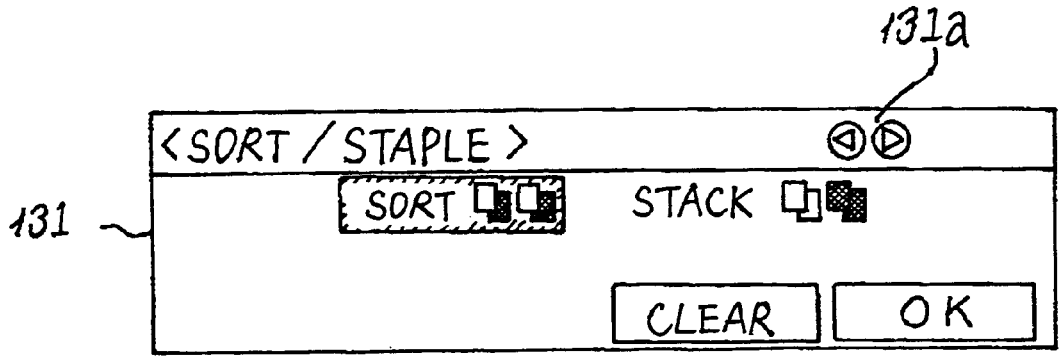
FIG. 22A is a view illustrating a display of the operation unit when either one of the sheet sorting device and the second sheet sorting device is operated.

Referring to FIG. 22A, the LCD panel 131 is divided into upper and lower sections. At the left side portion of the upper section of the LCD panel 131, the letters of "sort/staple" is displayed which is the same as the indication of the sort/staple selection key 133. At the right side portion of the upper section of the LCD panel 131, a mark 131*a* is displayed to instruct the operator to select by pressing the touch switches 132*a* and 132*b*. At the upper left side portion of the lower section of the LCD panel 131, the letters of "sort" and the illustrations indicating the sort mode are displayed. At the upper right side portion of the lower section of the LCD panel 131, the letters of "stack" and the illustrations indicating the stack mode are displayed. The sort mode and the stack mode can be switched by pressing the touch switches 132*a* and 132*b*. Because the sheet sorting device 16 and the second sheet sorting device 35 do not have a staple function, the staple mode can not be selected with any keys in the case of conditions (2) and (3).

At the lower right side portion of the lower section of the LCD panel 131, a "clear" switch and an "OK" switch are displayed. Because the sort mode is more frequently used than the stack mode in an image forming operation, the sort mode takes precedence over the stack mode. Accordingly, the letters of "sort" and the illustrations indicating the sort mode are preset to be highlighted on the LCD panel 131. The operator can switch to the stack mode by pressing the touch switch 132*b*. Further, when the operator needs to return to the sort mode, the stack mode is switched to the sort mode by pressing the touch switch 132*a*.

After the operator selects the sort mode or the stack mode and presses the "OK" switch, the selected mode is set and the LCD panel 131 switches to display the standard operational information for additional settings. To cancel the set mode, the operator presses the "clear" switch. Thus, the selected mode is cancelled and the standard operational information turns to be displayed on the LCD panel 131.

Figure 22B:
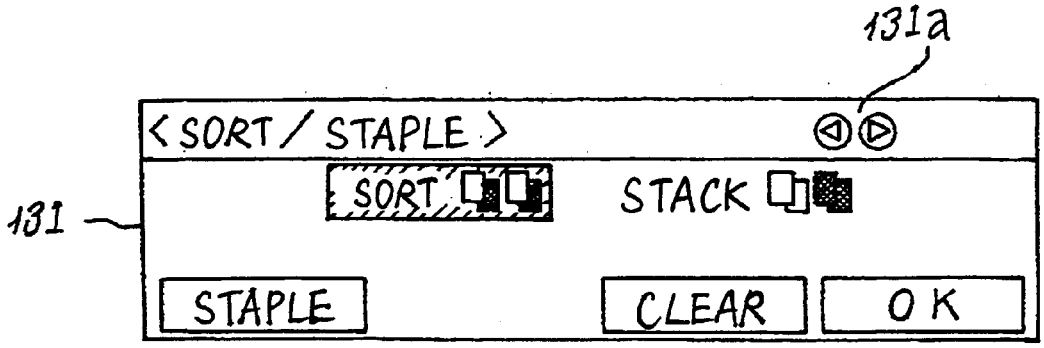
FIG. 22B is a view illustrating a display of the operation unit when the sheet post-processing device is operated.

In the case of condition (4), the sort/staple selection key 133 is active and the light-emitting display section 133*a* is lighted. The LCD panel 131 switches from the display of standard operational information to the display as illustrated in FIG. 22B. The display of FIG. 22B is substantially the same as that of FIG. 22A except a "staple" switch which is provided at the lower left side portion of the lower section of the LCD panel 131. By pressing the touch switch 132*b*, the letters of "staple" are highlighted and the staple mode is selected. Further, the staple mode is cancelled by pressing the highlighted letters of "staple." Consequently, the letters of "staple" return to non-highlighted condition, and then the sort mode is selected and the letters of "sort" and the illustrations indicating the sort mode are highlighted. Similarly to the conditions of (2) and (3) described in FIG. 22A, the sort mode takes precedence over the stack mode. By pressing the touch switch 132*b*, the sort mode is switched to the stack mode.

After the operator selects either one of the sort mode, the stack mode, and the staple mode and presses the "OK" switch, the selected mode is set and the LCD panel 131 switches to display the standard operational information for additional settings. To cancel the set mode, the operator presses the "clear" switch. Thus, the selected mode is cancelled and the standard operational information turns to be displayed on the LCD panel 131.

Thus, The CPU 32 controls to switch the operational information displayed on the operation unit 13 by recognizing if the sheet sorting device 16 or the sheet relaying device 38 is attached on the sheet discharging tray 10, or if the second sheet sorting device 35 or the sheet post-processing device 39 is attached in combination with the sheet relaying device 38, or if neither sheet sorting device 16 nor sheet relaying device 38 is attached on the sheet discharging tray 10.

Figure 17A:
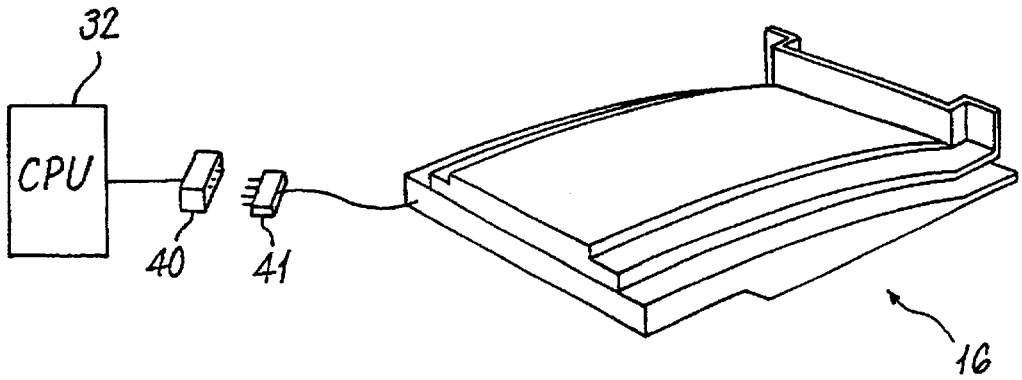
FIG. 17A is a perspective view illustrating each connector connecting to the sheet sorting device and a CPU.
Figure 17B:
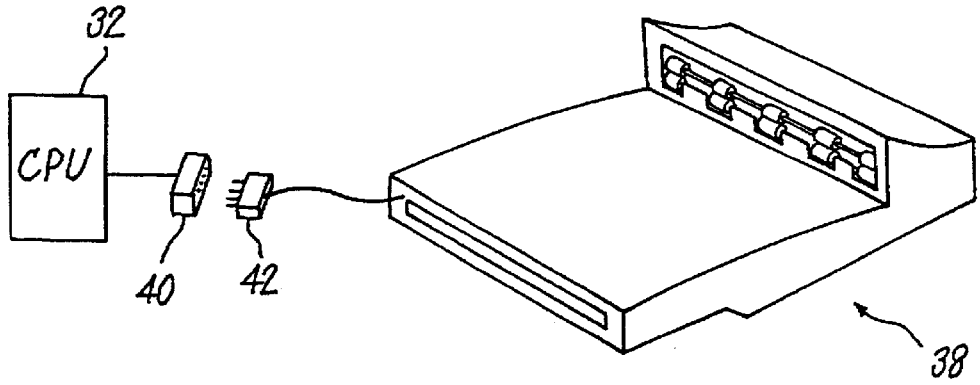
FIG. 17B is a perspective view illustrating each connector connecting to a sheet relaying device and the CPU.

In order to switch the operational information automatically, as illustrated in FIG. 17A, a connector 41 is provided with a tip portion of a line connecting to the motor 23 and the sensor 28 of the sheet sorting device 16. Further, as illustrated in FIG. 17B, a connector 42 is provided with a tip portion of a line connecting to the sheet relaying device 38 for driving and controlling the sheet relaying device 38.

Figure 16:
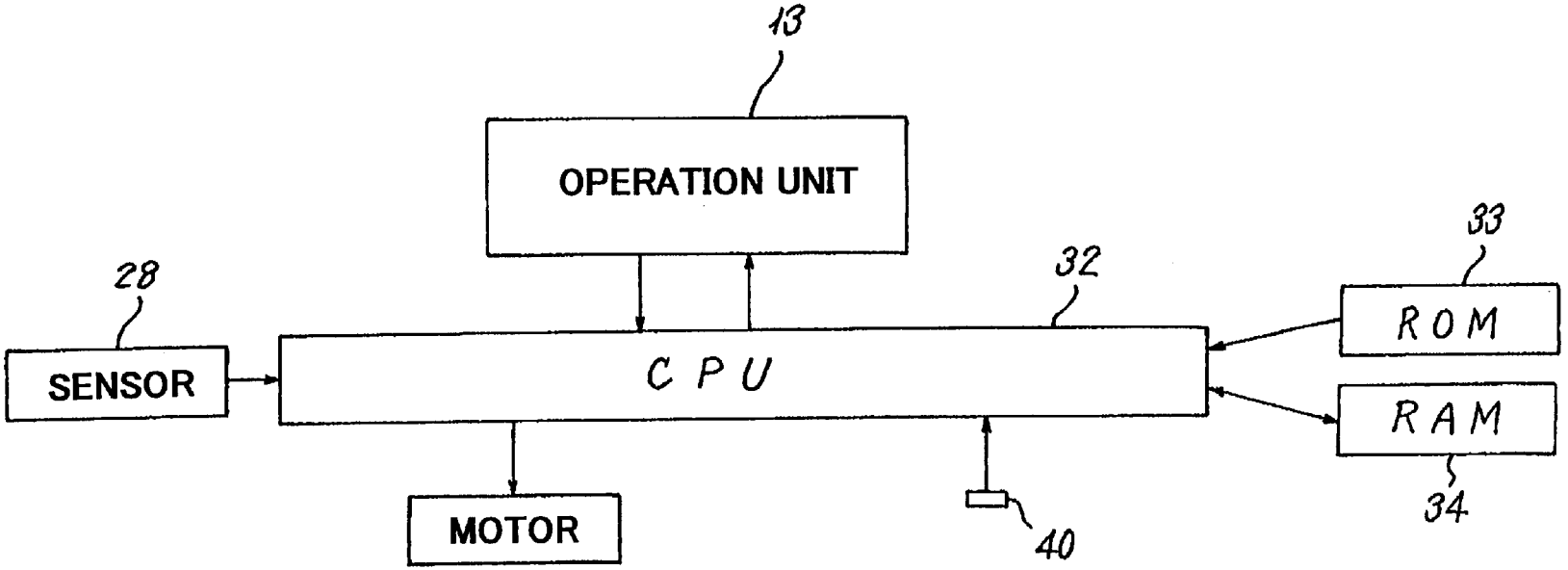
FIG. 16 is a block diagram illustrating a control device of the sheet discharging apparatus of the present invention.

The above-described connectors 41 and 42 can be connected to the connector 40 which connects to the CPU 32 as described in FIG. 16. For example, when the sheet sorting device 16 is attached on the sheet discharging tray 10, the connector 41 is connected to the connector 40. When the sheet relaying device 38 is attached on the sheet discharging tray 10, the connector 42 is connected to the connector 40.

When neither connector 41 nor 42 is connected to the connector 40, the CPU 32 recognizes that the sheet discharging apparatus 1 is in the above-described condition (1). When the connector 41 is connected to the connector 40, the CPU 32 recognizes that the sheet discharging apparatus 1 is in the above-described condition (2). When the connector 42 is connected to the connector 40, the CPU 32 recognizes that the sheet discharging apparatus 1 is in the above-described conditions (3) or (4). As described above, the second sheet sorting device 35 performs a sheet sorting in the condition (3), and the sheet post-processing device 39 performs a sheet sorting and a stapling in the condition (4).

Figure 17C:
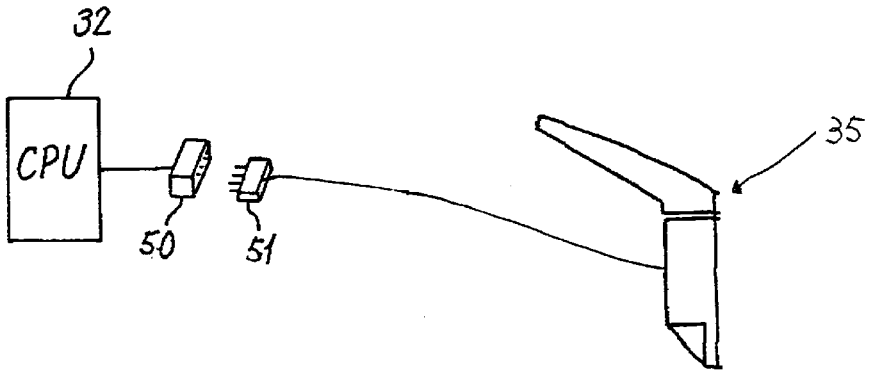
FIG. 17C is a perspective view illustrating each connector connecting to a second sheet sorting device and the CPU.
Figure 17D:
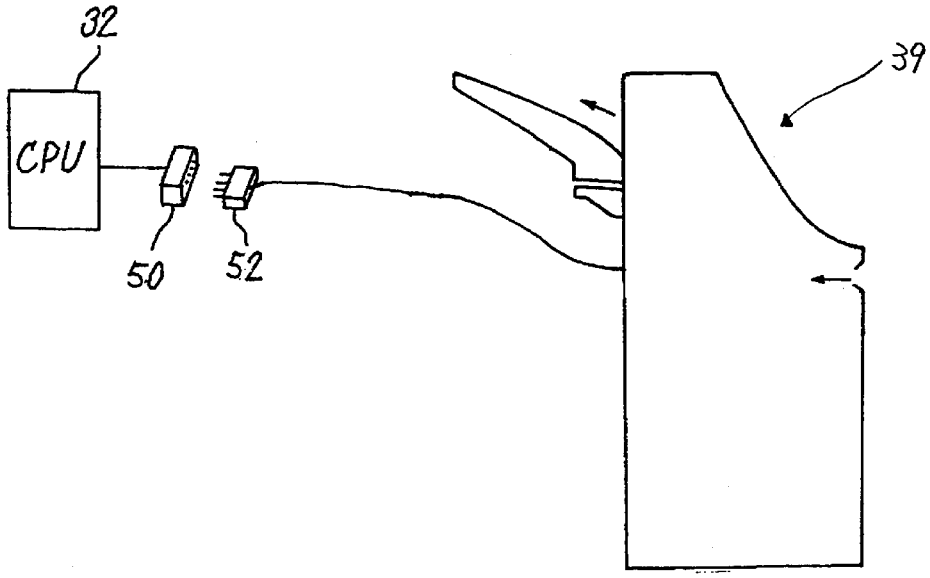
FIG. 17D is a perspective view illustrating each connector connecting to a sheet post-processing device and the CPU.

In order for the CPU 32 to recognize between the conditions (3) and (4), a connector 50 is connected to the CPU 32 as illustrated in FIGS. 17C and 17D. Further, as illustrated in FIG. 17C, a connector 51 is connected to the second sheet sorting device 35 via a line, and as illustrated in FIG. 17D, a connector 52 is connected to the sheet post-processing device 39 via a line. Each connector 51 and 52 can be connected to the connector 50 which connects to the CPU 32. The CPU 32 recognizes between the conditions (3) and (4) judging from the connection of the connectors 51 or 52 to the connector 50.

Specifically, when the connector 51 is connected to the connector 50, the CPU 32 recognizes that the sheet discharging apparatus 1 is in the condition (3). When the connector 52 is connected to the connector 50, the CPU 32 recognizes that the sheet discharging apparatus 1 is in the condition (4). The CPU 32 controls to switch the operational information displayed on the operation unit 13 in accordance with the CPU 32's recognition.

Figure 18A:
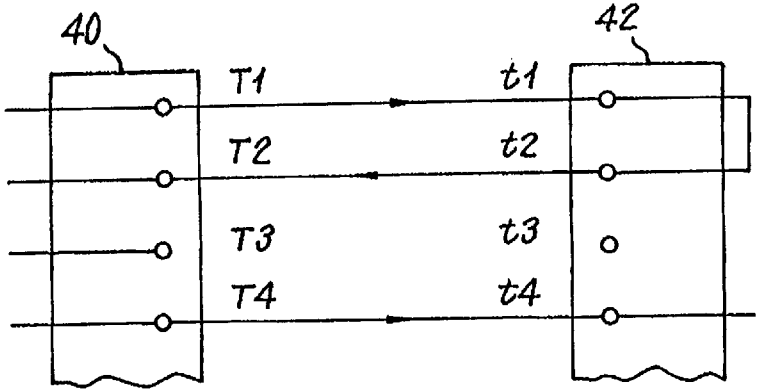
FIG. 18A is an explanatory view of connecting condition of connectors when the sheet relaying device is attached to the sheet discharging apparatus.
Figure 18B:
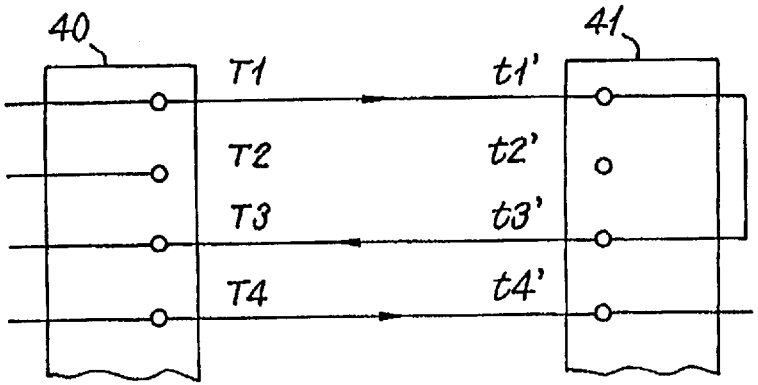
FIG. 18B is an explanatory view of connecting condition of connectors when the sheet sorting device is attached to the sheet discharging apparatus.

As illustrated in FIGS. 18A and 18B, the connector 40 includes four connector terminals T1, T2, T3, and T4 each of which connects to the CPU 32. Referring to FIG. 18A, the connector 42 for the sheet relaying device 38 includes four connector terminals t1, t2, t3, and t4, and the connector terminals t1 and t2 are connected. Referring to FIG. 18B, the connector 41 for the sheet sorting device 16 includes four connector terminals t1', t2', t3', and t4', and the connector terminals t1' and t3' are connected.

In FIG. 18A, when the signals output from the CPU 32 via the connector terminal T1 are input to the CPU 32 via the connector terminal T2, the CPU 32 recognizes that the sheet relaying device 38 is attached on the sheet discharging tray 10. In FIG. 18B, when the signals output from the CPU 32 via the connector terminal T1 are input to the CPU 32 via the connector terminal T3, the CPU 32 recognizes that the sheet sorting device 16 is attached on the sheet discharging tray 10. The connector terminal T4 which connects to the connector terminals t4 and t'4, and other connector terminals (not shown) are used for sending/receiving various information and for turning on/off the power, etc. When neither connectors 41 nor 42 is connected to the connector 40, the CPU 32 recognizes that neither sheet sorting device 16 nor sheet relaying device 38 is attached on the sheet discharging tray 10. That is, the CPU 32 recognizes that the sheet discharging tray 10 is used for receiving the sheets discharged from the sheet discharging rollers 9.

Figure 18C:
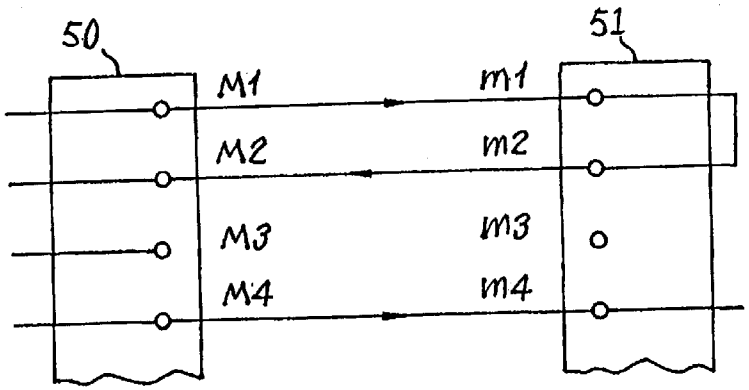
FIG. 18C is an explanatory view of connecting condition of connectors when the second sheet sorting device is attached to the sheet discharging apparatus.
Figure 18D:
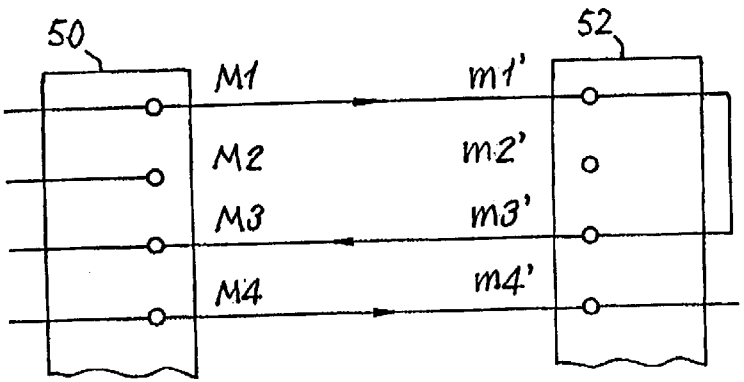
FIG. 18D is an explanatory view of connecting condition of connectors when the sheet post-processing device is attached to the sheet discharging apparatus of the present invention.

Similarly, the CPU 32 recognizes between the attachment of the second sheet sorting device 35 and the sheet post-processing device 39 by signals via connector terminals. As illustrated in FIGS. 18C and 18D, the connector 50 includes four connector terminals M1, M2, M3, and M4 each of which connects to the CPU 32. Referring to FIG. 18C, the connector 51 for the second sheet sorting device 35 includes four connector terminals m1, m2, m3, and m4, and the connector terminals m1 and m2 are connected. Referring to FIG. 18D, the connector 52 for the sheet post-processing device 39 includes four connector terminals m1', m2', m3', and m4', and the connector terminals m1' and m3' are connected.

In FIG. 18C, when the signals output from the CPU 32 via the connector terminal M1 are input to the CPU 32 via the connector terminal M2, the CPU 32 recognizes that the second sheet sorting device 35 is attached to the sheet discharging apparatus 1. In FIG. 18D, when the signals output from the CPU 32 via the connector terminal M1 are input to the CPU 32 via the connector terminal M3, the CPU 32 recognizes that the sheet post-processing device 39 is attached to the sheet discharging apparatus 1. The connector terminal M4 which connects to the connector terminals m4 and m'4, and other connector terminals (not shown) are used for sending/receiving various information and for turning on/off the power, etc. When neither connectors 51 nor 52 is connected to the connector 50, the CPU 32 recognizes that neither second sheet sorting device 35 nor sheet post-processing device 39 is attached to the sheet discharging apparatus 1.

Figure 23:
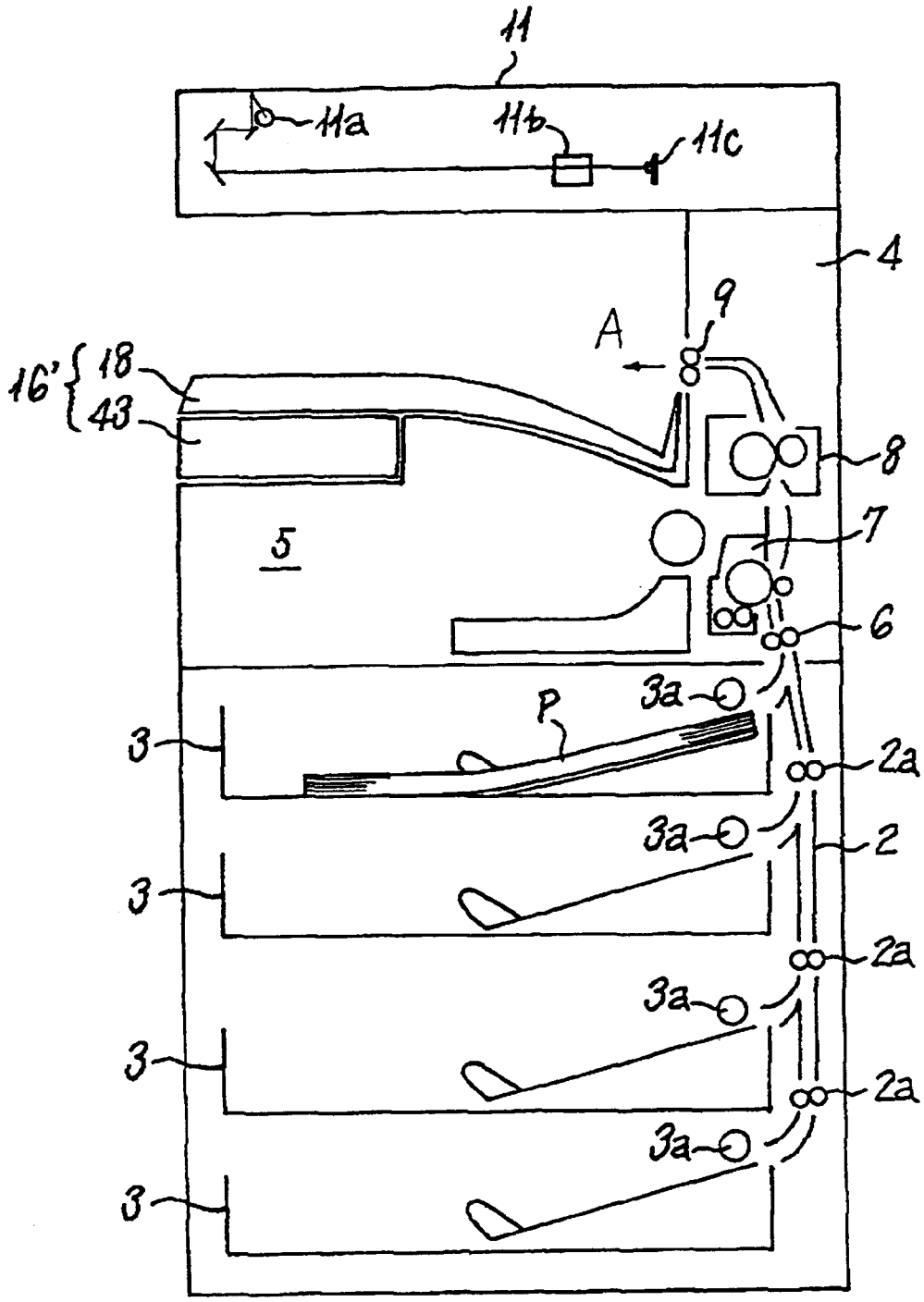
FIG. 23 is a schematic view illustrating an overall construction of a sheet discharging apparatus wherein a part of an alternative sheet sorting device is retracted into a recess of a main body of the sheet discharging apparatus.

In the above-described sheet discharging apparatus 1 according to the embodiments of the present invention, when the sheet sorting device 16 is attached, the base 17 of the sheet sorting device 16 is configured to be attached on the sheet discharging tray 10. As described above, because the image scanning unit 11 overhangs the sheet discharging tray 10, the stacking capacity of the movable tray 18 for the sorted sheets is limited. In order to expand the stacking capacity of the movable tray 18, an alternative sheet sorting device 16' can be employed. As illustrated in FIG. 23, the sheet sorting device 16' includes the movable tray 18 and a driving/base unit 43. Specifically, a base and a driving device are combined into the driving/base unit 43 in compact. For the attachment of the driving/base unit 43, a recess which is large enough to place the driving/base unit 43 is formed at the upper and downstream portion of the main body 5 in the sheet conveying direction A. Thus, the space for the base 17 of the sheet sorting device 16 can be saved by integrating the base and the driving device into the driving/base unit 43 and by retracting the driving/base unit 43 into the recess of the main body 5. As a result, more amount of sheets can be stacked on the movable tray 18.

Numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A sheet sorting device for a sheet discharging tray of a sheet discharging apparatus, comprising:

a base configured to be detachably attached to the sheet discharging tray of the sheet discharging apparatus;

a movable tray provided over the base and for receiving sheets discharged from the sheet discharging apparatus; and a driving device positioned between the movable tray and the base and underneath the movable tray, the driving device being configured to reciprocate the movable tray in a reciprocating direction which is substantially perpendicular to a sheet conveying direction of the sheet discharging apparatus.

2. The sheet sorting device according to claim 1, wherein the driving device is positioned between the movable tray and the base.

3. The sheet sorting device according to claim 1, wherein:

the base includes an attaching portion which secures the base to the sheet discharging tray; and the attaching portion is provided between the base and the sheet discharging tray, and includes at least one section configured to engage with a contour of the sheet discharging tray.

4. The sheet sorting device according to claim 1, wherein the movable tray includes at least one substantially vertical wall positioned to align edges of the sheets discharged from sheet discharging rollers of the sheet discharging apparatus in the sheet conveying direction.

5. A sheet sorting device for a sheet discharging tray of a sheet discharging apparatus, comprising:

a base configured to be detachably attached to the sheet discharging tray of the sheet discharging apparatus;

a movable tray provided over the base and for receiving sheets discharged from the sheet discharging apparatus; and a driving device positioned between the movable tray and the base and underneath the movable tray, the driving device being configured to reciprocate the movable tray in a reciprocating direction which is substantially perpendicular to a sheet conveying direction of the sheet discharging apparatus;

wherein:

the driving device is provided underneath a substantially center portion of the movable tray in the reciprocating direction, and has a plurality of side end portions along the sheet conveying direction; and the side end portions each have a height which is lower than a height of the substantially center portion of the movable tray.

6. A sheet sorting device for a sheet discharging tray of a sheet discharging apparatus, comprising:

a base configured to be detachably attached to the sheet discharging tray of the sheet discharging apparatus;

a movable tray provided over the base and for receiving sheets discharged from the sheet discharging apparatus; and a driving device positioned between the movable tray and the base and underneath the movable tray, the driving device being configured to reciprocate the movable tray in a reciprocating direction which is substantially perpendicular to a sheet conveying direction of the sheet discharging apparatus;

wherein the driving device includes a cam device having a motor fixed on the base facing the movable tray, a disk-shaped cam eccentrically fixed to a rotation shaft of the motor, and a sliding member configured to rotatably support the cam and be slidably guided in the reciprocating direction by a guide member provided to the movable tray.

7. The sheet sorting device according to claim 6, wherein the base supports the movable tray such that the movable tray moves only in the reciprocating direction.

8. A sheet sorting device for a sheet discharging tray of a sheet discharging apparatus, comprising:

a base configured to be detachably attached to the sheet discharging tray of the sheet discharging apparatus;

a movable tray provided over the base and for receiving sheets discharged from the sheet discharging apparatus; and a driving device positioned between the movable tray and the base and underneath the movable tray, the driving device being configured to reciprocate the movable tray in a reciprocating direction which is substantially perpendicular to a sheet conveying direction of the sheet discharging apparatus;

wherein the movable tray has a receiving surface having an inclining angle which is greater than an inclining angle of an inclined a receiving surface of the sheet discharging tray.

9. A sheet discharging system comprising:

a pair of sheet discharging rollers;

a sheet discharging tray positioned to receive sheets discharged from the sheet discharging rollers; and a sheet sorting device configured to be detachably attached to the sheet discharging tray and sort the sheets discharged from the sheet discharging rollers, the sheet sorting device comprising:

a base configured to be detachably attached to the sheet discharging tray of the sheet discharging apparatus;

a movable tray provided over the base and for receiving sheets discharged from the sheet discharging rollers; and a driving device positioned between the movable tray and the base and underneath the movable tray, the driving device being configured to reciprocate the movable tray in a reciprocating direction which is substantially perpendicular to a sheet conveying direction of the sheet discharging apparatus.

10. The sheet discharging system according to claim 9, wherein the driving device is positioned between the movable tray and the base.

11. The sheet discharging system according to claim 9, wherein:

the base includes an attaching portion which is configured to secure the base to the sheet discharging tray; and the attaching portion is provided between the base and the sheet discharging tray, and includes at least one section configured to engage with a contour of the sheet discharging tray.

12. The sheet discharging system according to claim 9, wherein the movable tray includes at least one substantially vertical wall positioned to align edges of the sheets discharged from the sheet discharging rollers in the sheet discharging direction.

13. The sheet discharging system according to claim 9, further comprising an image forming device configured to form an image on a sheet.

14. A sheet discharging system comprising:

a pair of sheet discharging rollers;

a sheet discharging tray positioned to receive sheets discharged from the sheet discharging rollers; and a sheet sorting device configured to be detachably attached to the sheet discharging tray and sort the sheets discharged from the sheet discharging rollers, the sheet sorting device comprising:

a base configured to be detachably attached to the sheet discharging tray of the sheet discharging apparatus;

a movable tray provided over the base and for receiving sheets discharge from the sheet discharging rollers; and a driving device positioned between the movable tray and the base and underneath the movable tray, the driving device being configured to reciprocate the movable tray in a reciprocating direction which is substantially perpendicular to a sheet conveying direction of the sheet discharging apparatus;

wherein:

the driving device is provided underneath a substantially center portion of the movable tray in the reciprocating direction, and has a plurality of side end portions along the sheet conveying direction; and the side end portions each have a height which is lower than a height of the substantially center portion of the movable tray.

15. The sheet discharging system according to claim 14, further comprising an image forming device configured to form an image on a sheet.

16. A sheet discharging system comprising:

a pair of sheet discharging rollers;

a sheet discharging tray positioned to receive sheets discharged from the sheet discharging rollers; and a sheet sorting device configured to be detachably attached to the sheet discharging tray and sort the sheets discharged from the sheet discharging rollers, the sheet sorting device comprising:

a base configured to be detachably attached to the sheet discharging tray of the sheet discharging apparatus;

a movable tray provided over the base and for receiving sheets discharged from the sheet discharging rollers; and a driving device positioned between the movable tray and the base and underneath the movable tray, the driving device being configured to reciprocate the movable tray in a reciprocating direction which is substantially perpendicular to a sheet conveying direction of the sheet discharging apparatus;

wherein the driving device includes a cam device having a motor fixed on the base facing the movable tray, a disk-shaped cam eccentrically fixed to a rotation shaft of the motor, and a sliding member configured to rotatably support the cam and be slidably guided in the reciprocating direction by a guide member provided to the movable tray.

17. The sheet discharging system according to claim 16, wherein the base supports the movable tray such that the movable tray moves only in the reciprocating direction.

18. The sheet discharging system according to claim 16, further comprising an image forming device configured to form an image on a sheet.

19. A sheet discharging system comprising:

a pair of sheet discharging rollers; and a sheet discharging tray positioned to receive sheets discharged from the sheet discharging rollers;

a sheet sorting device configured to be detachably attached to the sheet discharging tray and sort the sheets discharged from the sheet discharging rollers, the sheet sorting device comprising:

a base configured to be detachably attached to the sheet discharging tray of the sheet discharging apparatus;

a movable tray provided over the base and for receiving sheets discharged from the sheet discharging rollers; and a driving device positioned between the movable tray and the base and underneath the movable tray, the driving device being configured to reciprocate the movable tray in a reciprocating direction which is substantially perpendicular to a sheet conveying direction of the sheet discharging apparatus;

wherein the movable tray has a receiving surface having an inclining angle which is greater than an inclining angle of a receiving surface the sheet discharging tray.

20. The sheet discharging system according to claim 19, further comprising an image forming device configured to form an image on a sheet.

21. A sheet discharging system comprising:

a pair of sheet discharging rollers;

a sheet discharging tray positioned to receive sheets discharged from the sheet discharging rollers;

a sheet sorting device configured to be detachably attached to the sheet discharging tray and sort the sheet discharged from the sheet discharging rollers in a sheet conveying direction; and a sheet relaying device configured to relay the sheets discharged from the sheet discharging rollers to a downstream side in the sheet conveying direction and configured detachably attached to the sheet discharging tray when the sheet sorting device is not attached thereto.

22. The sheet discharging system according to claim 21, further comprising:

an operation unit configured to display operational information; and a control device configured to control the operation unit to switch the operational information to be displayed depending on an attachment of one of the sheet sorting device and the sheet relaying device.

23. The sheet discharging system according to claim 22, wherein:

the sheet sorting device and the sheet relaying device are connected to connectors including connector terminals, respectively;

the connector terminals connect each other in a different manner between the connectors connecting to the sheet sorting device and the sheet relaying device; and the control device electrically connects to a connector which connects to one of the connectors connecting to the sheet sorting device and the sheet relaying device.

24. The sheet discharging system according to claim 21, further comprising an image forming device configured to form an image on a sheet.

25. A sheet discharging system comprising:

a pair of sheet discharging rollers;

a sheet discharging tray positioned to receive sheets discharged from the sheet discharging rollers;

a sheet sorting device including a base configured to be detachably attached to the sheet discharging tray, a movable tray provided over the base and for receiving the sheets discharged from the sheet discharging rollers, the movable tray including a substantially vertical wall positioned to align edges of the sheets discharged from the sheet discharging rollers in a sheet discharging direction, and a driving device positioned between the movable tray and the base and underneath the movable tray, the driving device being configured to reciprocate the movable tray in a reciprocating direction which is substantially perpendicular to the sheet discharging direction of the sheet discharging apparatus; and a guide member configured to be positioned above an upper end portion of the substantially vertical wall to guide the sheets in the sheet discharging direction over the substantially vertical wall.

26. The sheet discharging system according to claim 25, the guide member is detachable.

27. The sheet discharging system according to claim 25, further comprising an image forming device configured to form an image on a sheet.

28. A sheet discharging system comprising:

a pair of sheet discharging rollers;

a movable tray configured to receive the sheets discharged from the sheet discharging rollers and configured to reciprocate in a reciprocating direction substantially perpendicular to a sheet conveying direction;

a detecting device configured to detect a position of the movable tray in the reciprocating direction; and a control device configured to control the movable tray to halt at a halt position based on the position detected by the detecting device.

29. The sheet discharging system according to claim 28, wherein the detecting device includes:

a mask plate provided along a half circle periphery of a rotatable body which rotates in synchronism with reciprocating motions of the movable tray; and a sensor provided on a stationary member such that the mask plate is positioned between a light-emitting unit and a light-receiving unit of the sensor.

30. The sheet discharging system according to claim 28, further comprising an image forming device configured to form an image on a sheet.

31. A sheet discharging system comprising:

a pair of sheet discharging rollers;

a movable tray configured to receive the sheets discharged from the sheet discharging rollers and configured to reciprocate in a reciprocating direction substantially perpendicular to a sheet conveying direction; and a control device configured to control the movable tray to receive a first sheet of the sheets at a start position.

32. The sheet discharging system according to claim 31, further comprising an image forming device configured to form an image on a sheet.

33. A sheet sorting device for a sheet discharging tray of a sheet discharging apparatus, comprising:

supporting means for detachably attaching to the sheet discharging tray;

receiving means for receiving sheets discharged from the sheet discharging apparatus; and a reciprocating device positioned entirely under the receiving means and configured to reciprocate the receiving means in a reciprocating direction substantially perpendicular to a sheet conveying direction of the sheet discharging apparatus.

34. The sheet sorting device according to claim 33, further comprising securing means for detachably securing the supporting means to the sheet discharging tray.

35. The sheet sorting device according to claim 33, wherein the receiving means includes aligning means for aligning edges of the sheets discharged from the sheet discharging apparatus in the sheet discharging direction.

36. A sheet sorting device for a sheet discharging apparatus, comprising:

receiving means for receiving sheets discharged from the sheet discharging apparatus; and a reciprocating device positioned entirely under the receiving means and configured to reciprocate the receiving means in a reciprocating direction substantially perpendicular to a sheet conveying direction of the sheet discharging apparatus;

wherein the reciprocating device is provided at substantially a center part of the receiving means in the reciprocating direction, and the receiving means has a side end portion along the sheet conveying direction at a side of an operation unit of the sheet discharging apparatus, the height of at least the side end portion being lower than a height of the center part of the receiving means.

37. A sheet sorting device for a sheet discharging apparatus, comprising:

attaching means for attaching the sheet sorting device to the sheet discharging apparatus;

receiving means for receiving sheets discharged from the sheet discharging apparatus; and a reciprocating device positioned between the attaching means and receiving means and under the receiving means and configured to reciprocate the receiving means in a reciprocating direction substantially perpendicular to a sheet conveying direction of the sheet discharging apparatus;

wherein the reciprocating device includes a cam device having a motor fixed on the attaching means facing the receiving means, a disk-shaped cam eccentrically fixed to a rotation shaft of the motor, and a sliding member configured to rotatably support the cam and be slidably guided in the reciprocating direction by a guide member provided to the receiving means.

38. A sheet discharging system comprising:

discharging means for discharging sheets;

a sheet discharging tray for receiving the sheets discharged from the discharging means; and a sorting device configured to sort the sheets discharged from the discharging means, the sorting device being configured to be detachably attached to the sheet discharging tray and including receiving means for receiving the sheets discharged from the discharging means and a reciprocating device positioned entirely under the receiving means and configured to reciprocate the receiving means in a reciprocating direction substantially perpendicular to a sheet conveying direction.

39. The sheet discharging apparatus according to claim 38, further comprising means for forming an image on a sheet.

40. A sheet discharging system comprising:

discharging means for discharging sheets;

a sheet discharging tray for receiving sheets discharged from the discharging means;

sorting means for sorting the sheets discharged from the discharging means;

attaching means for detachably attaching the sorting means to the discharging means in a sheet conveying direction; and relaying means for relaying the sheets discharged from the discharging means to a downstream side in the sheet conveying direction, the relaying means being detachably attached to the sheet discharging tray when the sorting means is not attached thereto.

41. A sheet discharging system comprising:

discharging means for discharging sheets;

receiving means for receiving sheets discharged from the discharging means;

a reciprocating device positioned entirely under the receiving means and configured to reciprocate the receiving means in a reciprocating direction substantially perpendicular to a sheet conveying direction;

aligning means for aligning edges of the sheets discharged from the discharging means in the sheet discharging direction; and guide means for guiding the sheets in the sheet conveying direction over the aligning means.

42. A sheet discharging system comprising:

discharging means for discharging sheets;

receiving for receiving the sheets discharged from the discharging means;

reciprocating means for reciprocating the receiving means in a reciprocating direction substantially perpendicular to a sheet conveying direction;

detecting means for detecting a position of the receiving means in the reciprocating direction; and controlling means for controlling the reciprocating means to halt at a halt position based on the position detected by the detecting means.

43. The sheet discharging system comprising:

discharging means for discharging sheets;

receiving means for receiving the sheets discharged from the discharging means;

reciprocating means for reciprocating the receiving means in a reciprocating direction substantially perpendicular to a sheet conveying direction; and controlling means for controlling the reciprocating means to receive a first sheet of the sheets at a start position.

* * * * *